US009022841B2

(12) United States Patent
Martin

(10) Patent No.: US 9,022,841 B2
(45) Date of Patent: May 5, 2015

(54) COIN COUNTING AND/OR SORTING MACHINES AND ASSOCIATED SYSTEMS AND METHODS

(71) Applicant: Coinstar, Inc., Bellevue, WA (US)

(72) Inventor: Douglas A. Martin, Woodinville, WA (US)

(73) Assignee: Outerwall Inc., Bellevue, WA (US)

( * ) Notice: Subject to any disclaimer, the term of this patent is extended or adjusted under 35 U.S.C. 154(b) by 25 days.

(21) Appl. No.: 13/906,126

(22) Filed: May 30, 2013

(65) Prior Publication Data

US 2014/0335770 A1 Nov. 13, 2014

Related U.S. Application Data

(60) Provisional application No. 61/821,003, filed on May 8, 2013.

(51) Int. Cl.

| | |
|---|---|
| ***G07D 3/00*** | (2006.01) |
| ***G07D 3/14*** | (2006.01) |
| ***G07D 9/00*** | (2006.01) |

(52) U.S. Cl.

CPC .. *G07D 3/00* (2013.01); *G07D 3/14* (2013.01); *G07D 9/008* (2013.01)

(58) Field of Classification Search

CPC ..... G07D 3/14; G07D 3/16; G07D 9/065; G07D 1/02; G07D 3/02; G07D 9/008; G07D 1/00; G07D 9/00; G07D 9/06; G07F 5/24; B65G 2812/02772; B65G 17/002; B65G 17/32; B65G 17/42; B65G 2201/0244; B65G 2201/02; B65G 2201/0261

USPC ..... 453/7, 11, 56; 198/867.11, 803.14, 198/397.01, 477.1, 396, 550.01; 221/253, 221/254

See application file for complete search history.

(56) References Cited

U.S. PATENT DOCUMENTS

| | | | |
|---|---|---|---|
| 269,461 | A | 12/1882 | Rakestraw |
| 379,811 | A | 3/1888 | Reimann |
| 382,864 | A | 5/1888 | Breese |

(Continued)

FOREIGN PATENT DOCUMENTS

| | | |
|---|---|---|
| AU | 695403 | 8/1998 |
| AU | 714452 | 1/2000 |

(Continued)

OTHER PUBLICATIONS

U.S. Appl. No. 13/489,043, filed Jun. 5, 2012, Borg et al.

(Continued)

*Primary Examiner* — Jeffrey Shapiro
(74) *Attorney, Agent, or Firm* — Perkins Coie LLP

(57) ABSTRACT

Coin processing apparatuses, such as consumer or commercial coin processing apparatuses for counting and/or sorting coins, are described herein. The apparatuses can include coin conveyors having a plurality of individual coin carriers linked together to form a chain. In some embodiments, each of the coin carriers includes a corresponding pocket that is configured to receive a coin from a coin hopper as the carrier chain passes through the coin hopper during its cycle. The coin carriers can carry the coins past one or more sensors for identification or "discrimination" of the coin denomination. After discrimination, the coins can be knocked from the carrier pockets and into, e.g., a selected coin chute for transfer to a collection bin.

29 Claims, 16 Drawing Sheets

(56) References Cited

U.S. PATENT DOCUMENTS 382,867 A 5/1888 Claspy
383,166 A 5/1888 Bailey
446,303 A 2/1891 Thompson
545,185 A 8/1895 Yost
1,010,993 A 12/1911 White
1,234,707 A 7/1917 Whistler
1,345,858 A 7/1920 Jenkins
1,473,745 A 11/1923 Stedman
1,512,447 A * 10/1924 Birdsall ..... 453/11
1,585,242 A 5/1926 Hageman
1,668,626 A 5/1928 Brandt
1,711,049 A 4/1929 Fonda et al.
1,813,296 A 7/1931 Kidwell
1,847,940 A 3/1932 Giles
1,934,839 A * 11/1933 Bock et al. ..... 453/11
1,945,948 A 2/1934 Morin
2,014,505 A 9/1935 Patche
2,119,676 A 6/1938 Heller
2,163,351 A * 6/1939 Paul ..... 453/11
2,317,351 A 4/1943 Andalikiewicz et al.
2,336,606 A 12/1943 Everett
2,390,147 A 12/1945 Hatton
2,398,955 A 4/1946 O'toole
2,461,314 A 2/1949 Davis et al.
2,519,357 A 8/1950 Dougherty
2,569,360 A 9/1951 Weingart
2,621,665 A 12/1952 McGee
2,644,470 A 7/1953 Labbe
2,646,805 A 7/1953 Anderson
2,856,561 A 4/1957 Giezendanner
2,865,561 A 12/1958 Rosapepe
2,869,723 A 1/1959 Autio
2,881,774 A 4/1959 Labbe
2,931,480 A 4/1960 Heim
2,960,377 A 11/1960 Simjian
2,964,181 A 12/1960 Demarest et al.
3,007,576 A 11/1961 Hannaford
3,009,555 A 11/1961 Seckula, Sr.
3,048,251 A 8/1962 Bower
3,056,132 A 9/1962 Simjian
3,065,467 A 11/1962 Prevost
3,066,858 A 12/1962 Tipton
3,121,435 A 2/1964 White
3,132,654 A 5/1964 Adams
3,143,118 A 8/1964 Haines
3,147,839 A 9/1964 White, Jr.
3,173,742 A 3/1965 Simjian
3,196,257 A 7/1965 Buchholtz et al.
3,196,887 A 7/1965 White, Jr.
3,286,805 A 11/1966 New
3,292,818 A 12/1966 Jaworski
3,297,242 A 1/1967 Karp
3,351,075 A * 11/1967 Weisskopf ..... 453/7
3,361,141 A * 1/1968 Weisskopf ..... 453/11
3,381,694 A 5/1968 Lempke
3,396,737 A 8/1968 Picollo
3,415,348 A 12/1968 Wahlberg
3,416,337 A 12/1968 Hutchins
3,463,171 A 8/1969 Dolman
3,589,492 A 6/1971 Shirley
3,599,771 A 8/1971 Hinterstocker
3,603,327 A 9/1971 Buchholz et al.
3,653,481 A 4/1972 Boxall et al.
3,680,566 A 8/1972 Tanaka et al.
3,695,448 A 10/1972 Johansson
3,752,168 A 8/1973 Bayha
3,763,871 A 10/1973 Jobst
3,788,440 A 1/1974 Propice et al.
3,791,574 A 2/1974 Picquot et al.
3,797,307 A 3/1974 Johnston
3,804,249 A 4/1974 Gibbons et al.
3,815,717 A 6/1974 Arseneau
3,818,918 A 6/1974 Nissmo et al.
3,870,137 A 3/1975 Fougere
3,901,368 A 8/1975 Klinger
3,903,721 A 9/1975 Aaron
3,941,226 A 3/1976 Drakes
3,948,280 A 4/1976 Dahl et al.
3,952,851 A 4/1976 Fougere et al.
3,960,293 A 6/1976 Sweet, II et al.
3,965,912 A 6/1976 Gross et al.
3,969,584 A 7/1976 Miller et al.
3,982,620 A 9/1976 Kortenhaus
3,984,660 A 10/1976 Oka et al.
3,998,237 A 12/1976 Kressin et al.
4,014,424 A 3/1977 Hall
4,036,242 A 7/1977 Breitenstein et al.
4,058,954 A 11/1977 Asami et al.
4,059,122 A 11/1977 Kinoshita
4,071,740 A 1/1978 Gogulski
4,083,776 A 4/1978 Shimoiizaka et al.
4,089,400 A 5/1978 Gregory, Jr.
4,092,990 A 6/1978 Bayne
4,099,722 A 7/1978 Rodesch et al.
4,100,925 A 7/1978 Fukunaga et al.
4,106,610 A 8/1978 Heiman
4,109,774 A 8/1978 Hayashi
4,111,216 A 9/1978 Brisebarre et al.
4,124,109 A 11/1978 Bissell et al.
4,141,372 A 2/1979 Gdanski et al.
4,148,331 A 4/1979 Nicolaus
4,157,139 A * 6/1979 Bjork ..... 209/552
4,167,949 A 9/1979 Hashimoto et al.
4,172,462 A 10/1979 Uchida et al.
4,184,366 A 1/1980 Butler
4,199,744 A 4/1980 Aldridge et al.
4,216,461 A 8/1980 Werth et al.
4,225,056 A 9/1980 Flubacker
4,228,811 A 10/1980 Tanaka et al.
4,230,213 A 10/1980 Spring
4,236,999 A 12/1980 Burgess et al.
4,238,324 A 12/1980 Musselmann et al.
4,240,589 A 12/1980 Martin et al.
4,249,552 A 2/1981 Margolin et al.
4,266,121 A 5/1981 Hirose et al.
4,266,651 A 5/1981 Strom
4,275,751 A 6/1981 Bergman
4,278,543 A 7/1981 Maniquis et al.
4,286,704 A 9/1981 Wood et al.
4,301,909 A 11/1981 Snavely
4,306,644 A 12/1981 Rockola et al.
4,321,672 A 3/1982 Braun et al.
4,326,620 A 4/1982 Felix et al.
4,334,604 A 6/1982 Davies
4,346,798 A 8/1982 Agey, III
4,356,829 A 11/1982 Furuya et al.
4,360,034 A 11/1982 Davila et al.
4,369,442 A 1/1983 Werth et al.
4,369,800 A 1/1983 Watanabe et al.
4,374,557 A 2/1983 Sugimoto et al.
4,376,442 A 3/1983 Gomez et al.
4,380,316 A 4/1983 Glinka et al.
4,383,540 A 5/1983 De Meyer et al.
4,398,550 A 8/1983 Shireman
4,412,292 A 10/1983 Sedam et al.
4,412,607 A 11/1983 Collins et al.
4,414,467 A 11/1983 Gould et al.
4,416,334 A 11/1983 Bouillon
4,416,365 A 11/1983 Heiman
4,434,359 A 2/1984 Watanabe et al.
4,436,103 A 3/1984 Dick
4,437,558 A 3/1984 Nicholson et al.
4,442,850 A 4/1984 Austin et al.
4,447,714 A 5/1984 Lundblad et al.
4,448,297 A 5/1984 Mendelsohn
4,460,003 A 7/1984 Barnes et al.
4,469,213 A 9/1984 Nicholson et al.
4,471,864 A 9/1984 Marshall
4,488,116 A 12/1984 Plesko
4,503,963 A 3/1985 Steiner
4,504,357 A 3/1985 Holbein et al.
4,506,685 A 3/1985 Childers et al.
4,509,122 A 4/1985 Agnew et al.
4,509,542 A 4/1985 Watanabe et al.

(56) References Cited

U.S. PATENT DOCUMENTS 4,509,633 A 4/1985 Chow
4,512,453 A 4/1985 Schuller et al.
4,533,054 A 8/1985 Sommer, Jr. et al.
4,534,492 A 8/1985 Schwarzli
4,535,794 A * 8/1985 Bellis et al. ..... 453/56
4,535,915 A 8/1985 West
4,538,719 A 9/1985 Gray et al.
4,542,817 A 9/1985 Paulson
4,543,969 A 10/1985 Rasmussen
4,554,446 A 11/1985 Murphy et al.
4,555,618 A 11/1985 Riskin
4,556,140 A 12/1985 Okada
4,558,711 A 12/1985 Ikuta Yoshiaki et al.
4,558,712 A 12/1985 Sentoku et al.
4,574,824 A 3/1986 Paulsen et al.
4,577,744 A 3/1986 Doucet et al.
4,587,984 A 5/1986 Levasseur et al.
4,588,712 A 5/1986 Toscano
4,597,487 A 7/1986 Crosby et al.
4,598,378 A 7/1986 Giacomo
4,611,205 A 9/1986 Eglise et al.
4,616,323 A 10/1986 Hayashi
4,616,776 A 10/1986 Blumenthal et al.
4,620,559 A 11/1986 Childers et al.
4,622,456 A 11/1986 Naruto et al.
4,625,851 A 12/1986 Johnson et al.
4,641,239 A 2/1987 Takesako
4,667,093 A 5/1987 MacDonald et al.
4,672,377 A 6/1987 Murphy et al.
4,677,565 A 6/1987 Ogaki et al.
4,694,845 A 9/1987 Zay
4,706,577 A 11/1987 Jones et al.
4,706,795 A 11/1987 Mikami et al.
4,716,799 A 1/1988 Hartmann
4,723,212 A 2/1988 Mindrum et al.
4,733,765 A 3/1988 Watanabe et al.
4,753,625 A 6/1988 Okada et al.
4,754,862 A 7/1988 Rawicz-Szczerbo et al.
4,767,917 A 8/1988 Ushikubo
4,775,353 A 10/1988 Childers et al.
4,775,354 A 10/1988 Rasmussen et al.
4,809,837 A 3/1989 Hayashi et al.
4,809,838 A 3/1989 Houserman
4,814,589 A 3/1989 Storch et al.
4,827,423 A 5/1989 Beasley et al.
4,831,374 A 5/1989 Masel
4,833,308 A 5/1989 Humble
4,836,352 A 6/1989 Tateno et al.
4,842,119 A 6/1989 Abe et al.
4,866,661 A 9/1989 de Prins
4,872,618 A 10/1989 Sato et al.
4,882,675 A 11/1989 Nichtberger et al.
4,882,724 A 11/1989 Vela et al.
4,883,158 A 11/1989 Kobayashi et al.
4,884,672 A 12/1989 Parker
4,895,238 A 1/1990 Speas
4,896,791 A 1/1990 Smith
4,898,564 A 2/1990 Gunn et al.
4,910,672 A 3/1990 Off et al.
4,914,381 A 4/1990 Narod et al.
4,915,205 A 4/1990 Reid et al.
4,921,463 A 5/1990 Primdahl et al.
4,926,997 A 5/1990 Parker
4,936,435 A 6/1990 Griner
4,936,436 A 6/1990 Keltner
4,950,986 A 8/1990 Guerrero
4,953,086 A 8/1990 Fukatsu et al.
4,959,624 A 9/1990 Higgins, Jr. et al.
4,960,196 A 10/1990 Kanehara et al.
4,963,118 A 10/1990 Gunn et al.
4,964,495 A 10/1990 Rasmussen
4,969,549 A 11/1990 Eglise et al.
4,977,502 A 12/1990 Baker et al.
4,978,322 A 12/1990 Paulsen
4,995,497 A 2/1991 Kai et al.
4,995,848 A 2/1991 Goh et al.
4,997,406 A 3/1991 Horiguchi et al.
5,010,238 A 4/1991 Kadono et al.
5,021,967 A 6/1991 Smith
5,022,889 A 6/1991 Ristvedt et al.
5,025,139 A 6/1991 Halliburton, Jr.
5,027,937 A 7/1991 Parish et al.
5,030,165 A 7/1991 Nilsson et al.
5,039,848 A 8/1991 Stoken
5,040,657 A 8/1991 Gunn et al.
5,042,635 A 8/1991 Bell
5,055,657 A 10/1991 Miller et al.
5,056,644 A 10/1991 Parker
5,067,604 A 11/1991 Metcalf
5,073,767 A 12/1991 Holmes et al.
5,078,252 A 1/1992 Furuya et al.
5,083,765 A 1/1992 Kringel
5,083,814 A 1/1992 Guinta et al.
5,088,587 A 2/1992 Goodrich et al.
5,091,713 A 2/1992 Horne et al.
5,097,934 A 3/1992 Quinlan, Jr.
5,098,339 A 3/1992 Dabrowski
5,098,340 A 3/1992 Abe
5,100,367 A 3/1992 Abe et al.
5,111,927 A 5/1992 Schulze, Jr.
5,113,974 A 5/1992 Vayda
5,114,381 A 5/1992 Ueda et al.
5,122,094 A 6/1992 Abe et al.
5,131,885 A 7/1992 Nakao et al.
5,135,433 A 8/1992 Watanabe et al.
5,145,046 A 9/1992 Satoh et al.
5,151,684 A 9/1992 Johnsen
5,158,166 A 10/1992 Barson et al.
5,163,868 A 11/1992 Adams et al.
5,166,886 A 11/1992 Molnar et al.
5,167,571 A 12/1992 Waller
5,168,961 A 12/1992 Schneider
5,173,851 A 12/1992 Off et al.
5,174,608 A 12/1992 Benardelli et al.
5,183,142 A 2/1993 Latchinian et al.
5,191,957 A 3/1993 Hayes
5,195,626 A 3/1993 Le Hong et al.
5,199,545 A 4/1993 Takamisawa et al.
5,201,396 A 4/1993 Chalabian et al.
5,217,100 A 6/1993 Thompson et al.
5,219,059 A 6/1993 Furuya et al.
5,222,584 A 6/1993 Zouzoulas
5,226,519 A 7/1993 DeWoolfson
5,226,520 A 7/1993 Parker
5,227,874 A 7/1993 Von Kohorn
5,227,966 A 7/1993 Ichiba
5,236,074 A 8/1993 Gotaas et al.
5,236,339 A 8/1993 Nishiumi et al.
5,244,070 A 9/1993 Carmen et al.
5,251,738 A 10/1993 Dabrowski
5,252,811 A 10/1993 Henochowicz et al.
5,254,032 A 10/1993 Abe et al.
5,263,566 A 11/1993 Nara et al.
5,279,404 A 1/1994 Bruner et al.
5,282,769 A 2/1994 Suzukawa
5,285,883 A 2/1994 Le Hong et al.
5,291,782 A 3/1994 Taylor
5,293,979 A 3/1994 Levasseur
5,293,980 A 3/1994 Parker
5,293,981 A 3/1994 Abe et al.
5,299,673 A 4/1994 Wu
5,302,811 A 4/1994 Fukatsu et al.
5,316,120 A 5/1994 Ibarrola
5,316,517 A 5/1994 Chiba et al.
5,317,135 A 5/1994 Finocchio
5,321,242 A 6/1994 Heath, Jr.
5,323,891 A 6/1994 Waite et al.
5,326,312 A 7/1994 Patroni
5,330,041 A 7/1994 Dobbins et al.
5,337,253 A 8/1994 Berkovsky et al.
5,345,071 A 9/1994 Dumont
5,346,049 A 9/1994 Nakajima et al.
5,347,115 A 9/1994 Sherman et al.
5,350,906 A 9/1994 Brody et al.

(56) References Cited

U.S. PATENT DOCUMENTS 5,351,798 A 10/1994 Hayes
5,355,988 A 10/1994 Shirasawa
5,356,333 A 10/1994 Bointon et al.
5,360,093 A 11/1994 Baer
5,361,871 A 11/1994 Gupta et al.
5,365,046 A 11/1994 Haymann
5,374,814 A 12/1994 Kako et al.
5,379,875 A 1/1995 Shames et al.
5,386,901 A 2/1995 Ibarrola et al.
5,386,902 A 2/1995 Bointon et al.
5,388,680 A 2/1995 Hird et al.
5,390,515 A 2/1995 Essick
5,392,891 A 2/1995 Ferguson et al.
5,404,985 A 4/1995 Baughman
5,408,417 A 4/1995 Wilder
5,409,092 A 4/1995 Itako et al.
5,421,147 A 6/1995 Holden et al.
5,429,222 A 7/1995 Delay et al.
5,429,551 A 7/1995 Uecker et al.
5,431,270 A 7/1995 Wohlrab et al.
5,433,310 A 7/1995 Bell
5,435,777 A 7/1995 Takatani et al.
5,439,089 A 8/1995 Parker
5,441,139 A 8/1995 Abe et al.
5,448,226 A 9/1995 Failing, Jr. et al.
5,449,058 A 9/1995 Kotler et al.
5,452,785 A 9/1995 Iwamoto et al.
5,457,305 A 10/1995 Akel et al.
5,458,225 A 10/1995 Iwamoto et al.
5,460,256 A 10/1995 Levasseur
5,461,561 A 10/1995 Ackerman et al.
5,469,951 A 11/1995 Takemoto et al.
5,469,952 A 11/1995 Kershaw et al.
5,477,952 A 12/1995 Castellano et al.
5,480,061 A 1/1996 Ellinger
5,483,363 A 1/1996 Holmes et al.
5,484,334 A 1/1996 Evdokimo
5,489,015 A 2/1996 Wood
5,494,145 A 2/1996 Cohrs et al.
5,494,147 A 2/1996 Takahashi et al.
5,496,211 A * 3/1996 Zimmermann ..... 453/3
5,499,707 A 3/1996 Steury
5,501,633 A 3/1996 Watkins et al.
5,503,262 A 4/1996 Baudat et al.
5,506,393 A 4/1996 Ziarno
5,513,738 A 5/1996 Hird et al.
5,515,960 A 5/1996 Wood
5,531,640 A 7/1996 Inoue
5,535,872 A 7/1996 Smith et al.
5,546,316 A 8/1996 Buckley et al.
5,554,070 A 9/1996 Takatoshi et al.
5,555,497 A 9/1996 Helbling
5,560,467 A 10/1996 Takemoto
5,564,546 A 10/1996 Molbak et al.
5,573,099 A 11/1996 Church et al.
5,577,959 A 11/1996 Takemoto et al.
5,579,887 A 12/1996 Leibu et al.
5,583,487 A 12/1996 Ackerman et al.
5,595,264 A 1/1997 Trotta, Jr.
5,616,074 A 4/1997 Chen et al.
5,619,932 A 4/1997 Efland et al.
5,620,079 A 4/1997 Molbak
5,624,017 A 4/1997 Plesko
5,637,845 A 6/1997 Kolls
5,641,050 A 6/1997 Smith et al.
5,650,604 A 7/1997 Marcous et al.
5,652,421 A 7/1997 Veeneman et al.
5,665,952 A 9/1997 Ziarno
5,679,070 A 10/1997 Ishida et al.
5,687,830 A 11/1997 Hayes et al.
5,695,395 A 12/1997 Ota et al.
5,696,908 A 12/1997 Muehlberger et al.
5,697,484 A 12/1997 Yeh
5,699,328 A 12/1997 Ishizaki et al.
5,704,049 A 12/1997 Briechle
5,711,704 A 1/1998 Hughes et al.
5,715,926 A 2/1998 Furneaux et al.
5,732,398 A 3/1998 Tagawa
5,743,429 A 4/1998 Morofsky
5,745,706 A 4/1998 Wolfberg et al.
5,746,299 A 5/1998 Molbak et al.
5,746,322 A 5/1998 LaVeine et al.
5,788,046 A 8/1998 Lamah et al.
5,799,767 A 9/1998 Molbak
5,799,768 A 9/1998 Bernier et al.
5,806,651 A 9/1998 Carmen et al.
5,839,956 A 11/1998 Takemoto et al.
5,842,916 A 12/1998 Gerrity et al.
5,868,236 A 2/1999 Rademacher
5,875,110 A 2/1999 Jacobs
5,880,444 A 3/1999 Shibata et al.
5,898,383 A 4/1999 Forsythe
5,901,828 A 5/1999 Monie et al.
5,909,792 A 6/1999 Gerlier et al.
5,909,793 A 6/1999 Beach et al.
5,909,794 A 6/1999 Molbak et al.
5,910,044 A 6/1999 Luciano, Jr. et al.
5,929,366 A 7/1999 Kennedy
5,936,541 A 8/1999 Stambler
5,941,363 A 8/1999 Partyka et al.
5,957,262 A 9/1999 Molbak et al.
5,974,146 A 10/1999 Randle et al.
5,975,276 A 11/1999 Yeh
5,988,345 A 11/1999 Bergeron et al.
5,988,348 A 11/1999 Martin et al.
5,991,413 A 11/1999 Arditti et al.
6,016,481 A 1/2000 Failing, Jr. et al.
6,017,063 A 1/2000 Nilssen
6,021,883 A 2/2000 Casanova et al.
6,026,946 A 2/2000 McCarty, Jr.
6,030,284 A 2/2000 Frank
6,042,471 A 3/2000 Tanaka
6,047,807 A 4/2000 Molbak
6,047,808 A 4/2000 Neubarth et al.
6,053,300 A 4/2000 Wood et al.
6,053,807 A 4/2000 Metzger et al.
6,056,104 A 5/2000 Neubarth et al.
6,059,650 A 5/2000 Stoltz et al.
6,068,550 A 5/2000 Breitholtz et al.
6,071,187 A 6/2000 Knutsson et al.
6,082,519 A 7/2000 Martin et al.
6,093,094 A 7/2000 Uecker et al.
6,095,313 A 8/2000 Molbak et al.
6,095,916 A 8/2000 Tamaki
6,105,009 A 8/2000 Cuervo
6,110,044 A 8/2000 Stern
6,116,402 A 9/2000 Beach et al.
6,119,099 A 9/2000 Walker et al.
6,138,106 A 10/2000 Walker et al.
6,144,946 A 11/2000 Iwamura et al.
6,168,001 B1 1/2001 Davis
6,174,230 B1 1/2001 Gerrity et al.
6,179,703 B1 1/2001 Knutsson et al.
6,185,545 B1 2/2001 Resnick et al.
6,196,371 B1 3/2001 Martin et al.
6,223,877 B1 5/2001 McGinty et al.
6,223,878 B1 5/2001 Cattani et al.
6,227,343 B1 5/2001 Neathway et al.
6,230,928 B1 5/2001 Hanna et al.
6,233,564 B1 5/2001 Schulze, Jr.
6,250,453 B1 6/2001 Furuya
6,253,809 B1 7/2001 Paradies
6,264,104 B1 7/2001 Jenkins et al.
6,289,324 B1 9/2001 Kawan
6,292,211 B1 9/2001 Pena
6,318,536 B1 11/2001 Korman et al.
6,349,972 B1 2/2002 Geiger et al.
6,375,080 B1 4/2002 Cremonese
6,398,001 B1 6/2002 Hutchinson et al.
6,398,637 B1 6/2002 Tsuchida
6,401,010 B1 6/2002 Takahashi
6,404,090 B1 6/2002 Phillips et al.
6,405,182 B1 6/2002 Cuervo
6,415,262 B1 7/2002 Walker et al.

(56) References Cited

U.S. PATENT DOCUMENTS

| | | | | |
|---|---|---|---|---|
| 6,471,030 | B1 | 10/2002 | Neubarth et al. | |
| 6,484,863 | B1 | 11/2002 | Molbak | |
| 6,484,864 | B2 | 11/2002 | Sugata | |
| 6,484,884 | B1 | 11/2002 | Gerrity et al. | |
| 6,494,776 | B1 | 12/2002 | Molbak | |
| 6,505,774 | B1 | 1/2003 | Fulcher et al. | |
| 6,520,308 | B1 | 2/2003 | Martin et al. | |
| 6,536,037 | B1 | 3/2003 | Guheen et al. | |
| 6,554,184 | B1 | 4/2003 | Amos | |
| 6,607,063 | B2 | 8/2003 | Kuwabara et al. | |
| 6,609,604 | B1 | 8/2003 | Jones et al. | |
| 6,666,318 | B2 | 12/2003 | Gerrity et al. | |
| 6,704,039 | B2 | 3/2004 | Pena | |
| 6,705,448 | B1 | 3/2004 | Steel et al. | |
| 6,725,630 | B2 | 4/2004 | Rea et al. | |
| 6,736,251 | B2 | 5/2004 | Molbak | |
| 6,758,316 | B2 | 7/2004 | Molbak | |
| 6,761,257 | B2 | 7/2004 | Karlsson | |
| 6,766,892 | B2 | 7/2004 | Martin et al. | |
| 6,778,693 | B2 | 8/2004 | Jones et al. | |
| 6,817,052 | B2 | 11/2004 | Grube | |
| 6,829,596 | B1 | 12/2004 | Frazee | |
| 6,854,581 | B2 | 2/2005 | Molbak | |
| 6,863,168 | B1 | 3/2005 | Gerrity et al. | |
| 6,957,746 | B2 | 10/2005 | Martin et al. | |
| 6,976,570 | B2 | 12/2005 | Molbak | |
| 7,014,029 | B2 | 3/2006 | Winters | |
| 7,014,108 | B2 | 3/2006 | Sorenson et al. | |
| 7,017,729 | B2 | 3/2006 | Gerrity et al. | |
| 7,028,827 | B1 | 4/2006 | Molbak et al. | |
| 7,044,285 | B2 | 5/2006 | Takebayashi | |
| 7,113,929 | B1 | 9/2006 | Beach et al. | |
| 7,131,580 | B2 | 11/2006 | Molbak | |
| 7,152,727 | B2 | 12/2006 | Waechter | |
| 7,209,582 | B2 | 4/2007 | Takahashi | |
| 7,213,697 | B2 | 5/2007 | Martin et al. | |
| 7,243,772 | B2 | 7/2007 | Harris et al. | |
| 7,280,696 | B2 | 10/2007 | Zakrzewski et al. | |
| 7,290,645 | B2 | 11/2007 | Hill et al. | |
| 7,303,119 | B2 | 12/2007 | Molbak | |
| 7,422,518 | B2 | 9/2008 | Kotani | |
| 7,464,802 | B2 | 12/2008 | Gerrity et al. | |
| 7,497,314 | B2 | 3/2009 | Umeda | |
| 7,520,374 | B2 | 4/2009 | Martin et al. | |
| 7,527,193 | B2 | 5/2009 | Molbak | |
| 7,549,526 | B2 | 6/2009 | Ohtomo | |
| 7,552,810 | B2 | 6/2009 | Mecklenburg | |
| 7,584,833 | B2 | 9/2009 | Howells | |
| 7,584,869 | B2 | 9/2009 | DeLazzer et al. | |
| 7,653,599 | B2 | 1/2010 | Doran et al. | |
| 7,658,668 | B2 | 2/2010 | Hill | |
| 7,708,130 | B2 | 5/2010 | Meyer et al. | |
| 7,748,619 | B2 | 7/2010 | Martin et al. | |
| 7,815,071 | B2 | 10/2010 | Martin et al. | |
| 7,865,432 | B2 | 1/2011 | Doran et al. | |
| 7,874,478 | B2 | 1/2011 | Molbak | |
| 7,971,699 | B2 | 7/2011 | Molbak et al. | |
| 8,024,272 | B2 | 9/2011 | Doran et al. | |
| 8,109,379 | B2 | 2/2012 | Sjostrom | |
| 8,490,771 | B2 | 7/2013 | Toji | |
| 8,522,950 | B2 | 9/2013 | Martin | |
| 8,550,227 | B1 | 10/2013 | Martin | |
| 8,550,294 | B2 | 10/2013 | Martin | |
| 8,739,955 | B1 | 6/2014 | Everhart | |
| 2001/0008200 | A1 | 7/2001 | Yoshida et al. | |
| 2001/0014838 | A1* | 8/2001 | Abe et al. | 700/226 |
| 2002/0026423 | A1 | 2/2002 | Maritzen et al. | |
| 2003/0057054 | A1 | 3/2003 | Waechter | |
| 2003/0201146 | A1* | 10/2003 | Abe et al. | 194/302 |
| 2004/0048566 | A1* | 3/2004 | Maki | 453/33 |
| 2006/0019591 | A1* | 1/2006 | Abe et al. | 453/18 |
| 2006/0025062 | A1 | 2/2006 | Masen et al. | |
| 2006/0113161 | A1* | 6/2006 | Umeda | 194/302 |
| 2008/0085671 | A1* | 4/2008 | Nishida | 453/57 |
| 2008/0171508 | A1* | 7/2008 | Enomoto et al. | 453/18 |
| 2009/0004959 | A2* | 1/2009 | Nishida | 453/57 |
| 2009/0159395 | A1 | 6/2009 | Gerrity et al. | |
| 2009/0166151 | A1 | 7/2009 | Martin et al. | |
| 2010/0054551 | A1 | 3/2010 | Decoux | |
| 2010/0227539 | A1* | 9/2010 | Aguado Vitas et al. | 453/56 |
| 2010/0330892 | A1 | 12/2010 | Nishida | |
| 2011/0189933 | A1* | 8/2011 | Hoffges | 453/56 |
| 2011/0195649 | A1 | 8/2011 | Abe et al. | |
| 2011/0259709 | A1 | 10/2011 | Grossmann | |
| 2013/0086973 | A1 | 4/2013 | Martin et al. | |

FOREIGN PATENT DOCUMENTS

| | | | |
|---|---|---|---|
| AU | 753323 | | 10/2002 |
| AU | 777507 | | 10/2004 |
| AU | 2005200256 | | 2/2005 |
| CA | 1053598 | | 5/1979 |
| CA | 2060630 | | 8/1992 |
| CA | 2067987 | | 11/1992 |
| CA | 2143943 | | 3/1994 |
| CA | 2189330 | | 11/1995 |
| CA | 2235925 | | 11/1995 |
| CA | 2259234 | | 1/1998 |
| CA | 2426411 | | 1/1998 |
| CA | 2426462 | | 1/1998 |
| CA | 2295129 | | 1/1999 |
| CA | 2581740 | | 1/1999 |
| CH | 680171 | | 6/1992 |
| DE | 660354 | | 5/1938 |
| DE | 1944488 | | 3/1971 |
| DE | 2516532 | | 10/1975 |
| DE | 2528735 | | 4/1976 |
| DE | 2800494 | | 7/1979 |
| DE | 3021327 | | 12/1981 |
| DE | 3147603 | | 6/1983 |
| DE | 288018 | | 3/1991 |
| EP | 0060392 | | 9/1982 |
| EP | 0091731 | | 10/1983 |
| EP | 0164733 | A2 | 12/1985 |
| EP | 0200873 | | 11/1986 |
| EP | 0209357 | | 1/1987 |
| EP | 0300781 | | 1/1989 |
| EP | 0304535 | | 3/1989 |
| EP | 0 351 217 | | 1/1990 |
| EP | 0420163 | | 4/1991 |
| EP | 0455200 | A2 | 11/1991 |
| EP | 0477722 | | 4/1992 |
| EP | 0657855 | | 6/1995 |
| EP | 0685826 | | 12/1995 |
| EP | 0710932 | | 5/1996 |
| EP | 0724237 | | 7/1996 |
| EP | 0857579 | | 8/1998 |
| EP | 0924662 | | 6/1999 |
| EP | 0924664 | | 6/1999 |
| EP | 0924665 | | 6/1999 |
| EP | 0766859 | | 10/2001 |
| EP | 1178448 | | 2/2002 |
| EP | 1231579 | | 8/2002 |
| EP | 1646014 | | 4/2006 |
| EP | 1939821 | | 7/2008 |
| EP | 1956563 | | 8/2008 |
| EP | 2045780 | A1 | 4/2009 |
| EP | 2226769 | | 9/2010 |
| EP | 2360649 | A1 | 8/2011 |
| EP | 2754136 | | 7/2014 |
| FR | 2042254 | | 2/1971 |
| FR | 2342531 | | 9/1977 |
| FR | 2845189 | | 4/2004 |
| GB | 807880 | A | 1/1959 |
| GB | 958741 | | 5/1964 |
| GB | 1255492 | | 12/1971 |
| GB | 1564723 | | 4/1980 |
| GB | 20798460 | A | 1/1982 |
| GB | 2095452 | | 9/1982 |
| GB | 2121582 | | 12/1983 |
| GB | 2130299 | A | 5/1984 |
| GB | 2153128 | | 8/1985 |
| GB | 2169429 | | 7/1986 |
| GB | 2175427 | | 11/1986 |

(56) References Cited

FOREIGN PATENT DOCUMENTS

| | | | |
|---|---|---|---|
| GB | 2186411 | | 8/1987 |
| GB | 2188467 | | 9/1987 |
| GB | 2198274 | | 6/1988 |
| GB | 2223340 | | 4/1990 |
| GB | 2223872 | | 4/1990 |
| GB | 2225918 | A | 6/1990 |
| GB | 2237912 | A | 5/1991 |
| GB | 2255666 | | 11/1992 |
| GB | 2341710 | | 3/2000 |
| GB | 2341711 | | 3/2000 |
| GB | 2356966 | | 6/2001 |
| GB | 2357885 | | 7/2001 |
| GB | 2357886 | | 7/2001 |
| GB | 2358271 | | 7/2001 |
| GB | 2358272 | | 7/2001 |
| GB | 2358273 | | 7/2001 |
| JP | 5249892 | | 4/1977 |
| JP | 5250296 | | 4/1977 |
| JP | 53049497 | | 5/1978 |
| JP | 55-159467 | | 12/1980 |
| JP | 58-121491 | | 7/1983 |
| JP | 59-148709 | | 8/1984 |
| JP | 0097469 | | 5/1985 |
| JP | 61-065572 | | 4/1986 |
| JP | 62-50876 | | 3/1987 |
| JP | 63-4390 | | 1/1988 |
| JP | 1258092 | | 10/1989 |
| JP | 1307891 | | 12/1989 |
| JP | 2081193 | | 3/1990 |
| JP | 3-63795 | | 3/1991 |
| JP | 392994 | | 4/1991 |
| JP | 3252795 | | 11/1991 |
| JP | 0433194 | | 2/1992 |
| JP | 4-67776 | | 6/1992 |
| JP | 4315288 | | 11/1992 |
| JP | 4344995 | | 12/1992 |
| JP | 5-200364 | | 8/1993 |
| JP | 07306976 | | 11/1995 |
| JP | 2000163587 | A | 6/2000 |
| JP | 200351043 | | 9/2004 |
| JP | 2009-211207 | A | 9/2009 |
| JP | 2009294693 | A | 12/2009 |
| JP | 2011248775 | A | 12/2011 |
| JP | 54-57921 | B2 | 4/2014 |
| KR | 10-2007-0106819 | | 11/2007 |
| MX | 9605331 | | 12/1997 |
| NZ | 333535 | | 8/2000 |
| SE | 44244 | | 9/1918 |
| SE | 44247 | | 9/1918 |
| SE | 50250 | | 11/1919 |
| SE | 8801851 | | 11/1989 |
| WO | WO-8700102 | | 1/1987 |
| WO | WO-8705729 | | 9/1987 |
| WO | WO-8800274 | | 1/1988 |
| WO | WO-8800592 | | 1/1988 |
| WO | WO-8808174 | | 10/1988 |
| WO | WO-8901209 | | 2/1989 |
| WO | WO-9100209 | | 1/1991 |
| WO | WO-9302431 | | 2/1993 |
| WO | WO-9307846 | A1 | 4/1993 |
| WO | WO-9406101 | | 3/1994 |
| WO | WO-9409440 | | 4/1994 |
| WO | WO-9505356 | | 2/1995 |
| WO | WO-95/30215 | | 11/1995 |
| WO | WO-96/30877 | | 10/1996 |
| WO | WO-9707485 | | 2/1997 |
| WO | WO-97/33257 | | 9/1997 |
| WO | WO-9950785 | | 10/1999 |
| WO | WO-0010138 | | 2/2000 |
| WO | WO-2008024043 | | 2/2008 |

OTHER PUBLICATIONS

U.S. Appl. No. 13/691,047, filed Nov. 30, 2012, Everhart.
U.S. Appl. No. 13/778,461, filed Feb. 27, 2013, Martin.
U.S. Appl. No. 13/793,827, filed Mar. 11, 2013, Everhart.
"The Electrical Engineering Handbook", 2nd Ed. Published by CRC Press and IEEE in 1997, Edited by Richard C. Dorf, pp. 23-31.
Accessories Brochure, Jun. 16, 2005, 3 pages.
Bedienungsanleitung CDS 500/MCC 500, 1991, 9 pages.
Cash, M., "Bank Blends New Technology with Service", Winnipeg Free Press, Sep. 4, 1992, 1 page.
CDS Automated Receipt Giving Cash Deposit System, Case-ICC Limited, Dec. 22, 2006, 3 pages.
Cohen, P., "Coinstar Turns Loose Change into iTunes Songs," Yahoo News, http://news.yahoo.com/s/macworld/20060410/tc_macworld/coinstar20060410_0, Apr. 10, 2006, pp. 1-3.
F. Zimmerman & Co., "Reference Manual Contovit/Sortovit, Perconta Money Counting and Sorting Systems," Aug. 1995, pp. I-III, 1-31, and three pages of specifications.
Fri Kopenskap articles, Mar. 18, 1988, Apr. 27, 1989 and Nov. 25, 1988, 6 pages.
Geldinstitute Literature, Mar. 1990 and Apr.-May 1992, 2 pages.
Hamilton, Martha M., "Turning Cans into Cold Cash", *The Washington Post*, Jul. 2, 1991, pp. D1, D4, pp. 194-209.
Kundenselbstbedienung, Dec. 22, 2006, 4 pages.
Kunderna fixar vaxeln, Praktiska, Dec. 12, 2006, 2 pages.
Leitch, C., "High-tech bank counts coins," *Innovations*, Report on Business, Sep. 18, 1991, 1 page.
Liemeon, J., "Royal's Burlington drive-in bank provides customers 24-hour tellers," *Business Today, The Toronto Star*, Aug. 21, 1991, 1 page.
NCR, "NCR 7800 Consumer Price Verifier," http://www3.ncr.com/product/retail/product/catalog/7800.shtml, accessed Mar. 18, 1999, 2 pages.
Oxby, M., "Royal Bank opens 'Super Branch,'" *The Gazette Montreal*, Sep. 14, 1991, 1 page.
Reis Eurosystems Geldbearbeitungssysteme, "Test-Programme CS 3110 Selectronic Coin Sorting and Counting Machine", Jul. 1992, 5 pages.
Reis Eurosystems, "Operating Instructions CS 3110 Selectronic Coin Sorting and Counting Machine With Central Sensor", Jul. 1992, 10 pages.
SC4000 Coin Discriminating System, Including Perforated, Vibrating Coin Feeding and Cleaning Tray Assembly; On sale in the US by Scan Coin Since at least Dec. 1994 (including photographs, drawings and parts lists), 92 pages.
Scan Coin 102 Value Counter, Brochure, Undated, 2 pages.
Scan Coin 4000 Value Sorter, Operator's Instruction Manual, Jun. 1995, 56 pages.
Scan Coin AB, "Scan Coin 4000 Value Sorter" and product photos, on sale in the U.S. prior to Sep. 2001, 11 pages.
Scan Coin AA, 1989, Jagershillgatan 26, S-213, 75 Malmo, Sweden, Technical Referens Manual, CDS Coin Deposit System, 47 pages.
Scan Coin CDS 600 Cash Deposit System, Brochure, Jun. 15, 1994, 2 pages.
Scan Coin CDS 640 Cash Deposit System Brochure, published at least by May 12, 2006, 2 pages.
Scan Coin CDS Brochure, Sep. 1988, 6 pages.
Scan Coin CDS Mini Cash Deposit System, Brochure, Undated, 2 pages.
Scan Coin CDS Munzgeldeinzahlungen in Selbstbedienung: Cash Deponier System CDS 500, 1994, 6 pages.
Scan Coin correspondence regarding supermarkets, Sep. 11, 1992, 4 pages.
Scan Coin International Report, Apr. 1987, 49 pages.
Scan Coin Money Processing Systems, Oct. 1, 1988, 9 pages.
Scan Coin Newsletter, May 1991, 2 pages.
Scan Coin Sales Invoices for Coin Counters in the United States, 1989-1993, 29 pages.
Scan Coin SC4000 Operating Instructions, dated Aug. 10, 1994, 6 pages.
Scan Coin Technical Manual CDS MK 1 Coin Deposit System; 1991, 98 pages.
Scan Coin Technical Manual SC 102 Value Counter, Available prior to Jul. 2011, 28 pages.
Scan Coin Technical Manual SC4000, dated Jul. 29, 1994, 12 pages.
Scan Coin User's Manual, CDS 600, 1991, 14 pages.

(56) References Cited

OTHER PUBLICATIONS

Scan Coin User's Manual, CDS 640, 1988, 7 pages.
Scan Coin World Newsletters, Scan Coin AB, Jagerhillgatan 26, S-213 75 Malmo, Sweden, 1988-1990, 6 pages.
Sheehan, Michael, "Marriage of Convenience," available at <http://www.kioskbusiness.com/NovDec01/articles/article4.html>, accessed May 19, 2003, 3 pages.
Slide Changing Apparatus With Slide Jam Protection, Research Disclosure 30509, Sep. 1989, 3 pages.
Super Branch Literature, Feb. 1992, 2 pages.
Svenska Penninglotteriet Documents, 1988, 70 pages.
Technical Manual, Cash Deposit System, Model CDS 600 & CDS 640, 1991, 46 pages.
Technical Specifications GBS9401 SB, Prior to Nov. 10, 2010, 24 pages.
Wennergren-Williams, "Who Wants a Computer Consultant Who Thinks the Same Way as Everyone Else?" Priab Prisma, vol. 1, 1989, 7 pages.
Scan Coin Technical Reference Manual CDS Coin Deposit System (odd pages only) 1989, 47 pages.
U.S. Appl. No. 09/035,273, filed Mar. 9, 1998, Molbak et al.
U.S. Appl. No. 09/225,774, filed Jan. 4, 1999, Molbak et al.
U.S. Appl. No. 14/158,514, filed Jan. 17, 2014, Baltazor et al.
U.S. Appl. No. 14/177,213, filed Feb. 10, 2014, Martin et al.
"Input Capture/Output Compare Combination in PIC24FJ64GB002 Problems," Microchip.com [online], May 6, 2011, Retrieved from the Internet: URL: http://www.microchip.com/forums/m576742.aspx, 4 pages.
European Office Action for European Application No. 05025871.4, Mail Date Jun. 30, 2014, 5 pages.
Japanese Office Action for Japanese Application No. 2013-213549, Mail Date Aug. 11, 2014, 15 pages.
Reisert, Marco et al. "A Fast and Reliable Coin Recognition System," Pattern Recognition—Lecture Notes in Computer Science, vol. 4713, 2007, pp. 415-424.
Schindler, Konrad, "Geometry and Construction of Straight Lines in Log-polar Images," Computer Vision and Understanding, 103, 2006, pp. 196-207.
Schubert, Erhard et al. "A Vision Based Coin Inspection System," SPIE vol. 2908, 1996, pp. 86-96.

* cited by examiner

COIN COUNTING AND/OR SORTING MACHINES AND ASSOCIATED SYSTEMS AND METHODS

CROSS-REFERENCE TO RELATED APPLICATION INCORPORATED BY REFERENCE

The present application claims priority to and the benefit of U.S. Provisional Patent Application No. 61/821,003, entitled "COIN COUNTING AND/OR SORTING MACHINES AND ASSOCIATED SYSTEMS AND METHODS," filed May 8, 2013, and incorporated herein in its entirety by reference.

TECHNICAL FIELD

The following disclosure relates generally to coin processing machines and, more particularly, to machines for counting and/or sorting coins, such as consumer coins and the like.

BACKGROUND

Various types of coin counting machines are known. Some coin counting machines (e.g., vending machines, gaming devices such as slot machines, and the like) are configured to receive one coin at a time through a slot. These machines are relatively simple and typically designed for relatively low throughput and little, if any, coin cleaning. Such machines, however, are usually ill-suited for counting large quantities of consumer coins received all at once (such as a large quantity of coins poured into a machine from, e.g., a coin jar).

Machines for counting relatively large quantities of consumer coins include those disclosed in, for example, U.S. Pat. Nos. 5,620,079, 7,028,827, 7,520,374, and 7,865,432, each of which is incorporated herein by reference in its entirety. Some of these machines count consumer coins and dispense redeemable cash vouchers, while others may offer other types of products and services such as prepaid gift cards, prepaid phone cards, and/or "e-certificates." The vouchers can be redeemed for cash and/or merchandise at a point of sale (POS) in a retail establishment. The e-certificates can enable the holder to purchase items online by inputting a code from the e-certificate when making the purchase. Prepaid gift cards can be used to make POS purchases by swiping the card through a conventional card reader, and prepaid phone cards can be used for making cell phone calls. These coin counting machines typically include sensors and similar devices for discriminating coin denominations, discriminating coins from non-coin objects, and/or discriminating coins of one country from those of another.

Various types of sensors and other devices for identifying and/or discriminating coins in coin-counting machines are known. Such devices include those disclosed in, for example, the following: U.S. Pat. No. 6,196,371 and U.S. patent application Ser. No. 13/269,121, filed Oct. 7, 2011, and entitled "AUTO-CALIBRATION SYSTEMS FOR COIN COUNTING DEVICES"; Ser. No. 13/489,043, filed Jun. 5, 2012, and entitled "OPTICAL COIN DISCRIMINATION SYSTEMS AND METHODS FOR USE WITH CONSUMER-OPERATED KIOSKS AND THE LIKE"; Ser. No. 13/612,429, filed Sep. 12, 2012, and entitled "AUTO-POSITIONING SENSORS FOR COIN COUNTING DEVICES"; and Ser. No. 13/691,047, filed Nov. 30, 2012, and entitled "DIFFERENTIAL DETECTION COIN DISCRIMINATION SYSTEMS AND METHODS FOR USE WITH CONSUMER-OPERATED KIOSKS AND THE LIKE"; Ser. No. 13/778,461, filed Feb. 27, 2013, and entitled "COIN COUNTING AND SORTING MACHINES"; and Ser. No. 13/793,827, filed Mar. 11, 2013, and entitled "DISCRIMINANT VERIFICATION SYSTEMS AND METHODS FOR USE IN COIN DISCRIMINATION," each of which is incorporated herein by reference in its entirety.

Speed and accuracy are important considerations in coin counting machines. Consumers are less inclined to use a coin counting machine if they have to wait an appreciable amount of time to have their coins counted. Coin counting machines should also be accurate and easy to use to encourage use. Accordingly, it is generally advantageous to provide coin counting machines that can count large quantities of coins relatively easily and quickly.

DETAILED DESCRIPTION

Figure 1A:
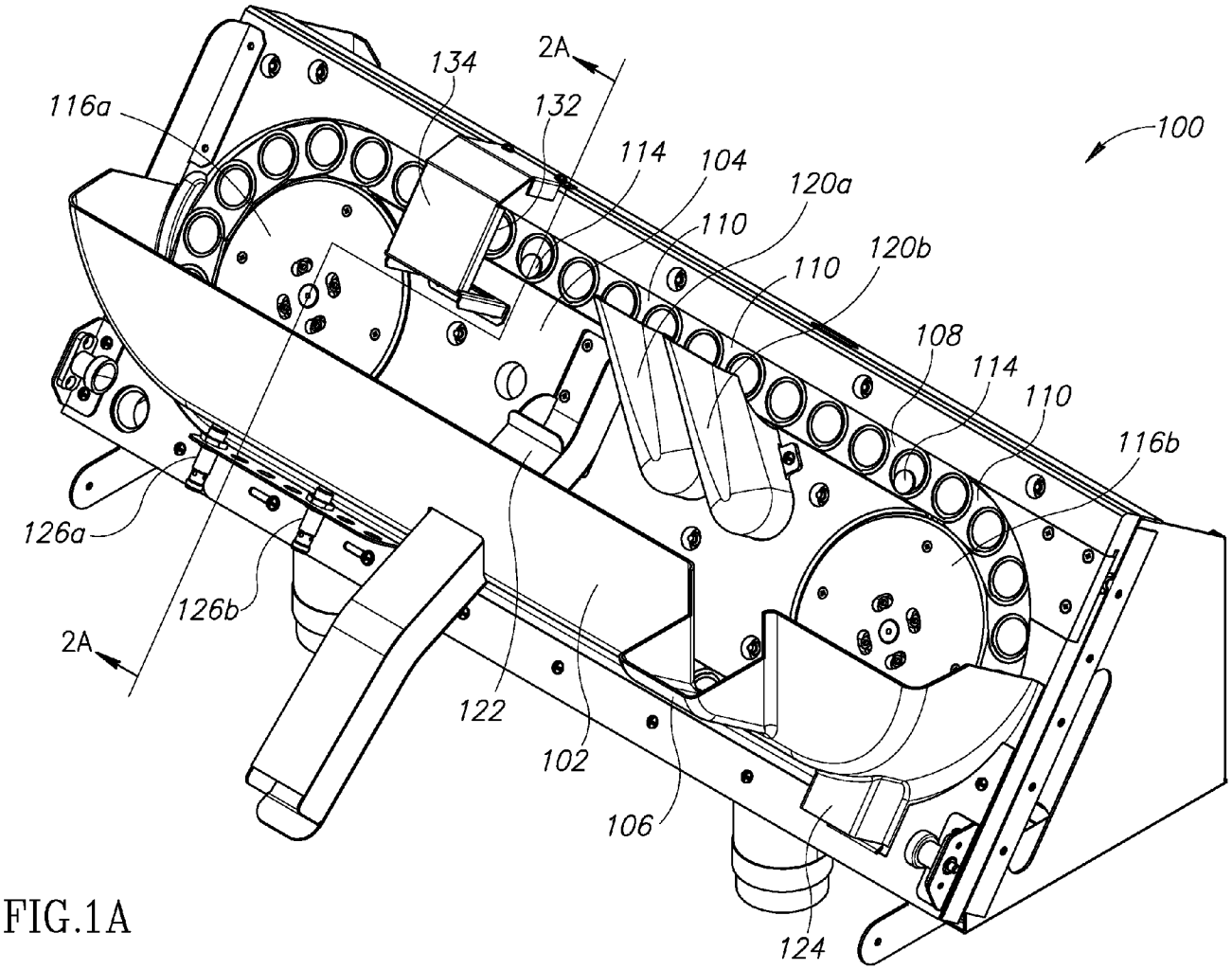
FIG. 1A is a front isometric view of a coin counting and/or sorting apparatus configured in accordance with an embodiment of the present technology.

The following disclosure describes various embodiments of apparatuses, systems and associated methods for counting and/or sorting coins. As described in greater detail below, in various embodiments the coin counting and/or sorting apparatuses disclosed herein can include an endless coin carrier chain supported by two sprockets. The coin carrier chain (or coin "conveyor") includes a plurality of individual coin carriers linked together to form the chain. In this embodiment, each of the coin carriers includes a corresponding coin pocket that is configured to pick up coins from a coin hopper as the carrier chain circulates through the coin hopper. The carriers can carry the coins past one or more sensors for identification or "discrimination" of the coin denomination. After discrimination (and, for example, counting), the coins can be knocked from the carrier pockets and into, e.g., a selected coin chute for transfer to a collection bin.

The coin processing apparatuses described herein can be used to count coins, to sort coins, or to count and sort coins, in various embodiments of consumer-operated coin processing machines configured to receive large batches of random coins from users in exchange for, e.g., redeemable cash vouchers, prepaid cards (e.g., gift cards), e-certificates, on-line accounts, mobile wallets, etc. Certain details are set forth in the following description and in FIGS. 1-11 to provide a thorough understanding of various embodiments of the present technology. In some instances well-known structures, materials, operations, and/or systems often associated with coin counting machines and associated systems and methods are not shown or described in detail herein to avoid unnecessarily obscuring the description of the various embodiments of the technology. Those of ordinary skill in the art will recognize, however, that the present technology can be practiced without one or more of the details set forth herein, or with other structures, methods, components, and so forth.

The accompanying Figures depict embodiments of the present technology and are not intended to be limiting of its scope. The sizes of various depicted elements are not necessarily drawn to scale, and the various elements may be arbitrarily enlarged to improve legibility. Component details may be abstracted in the Figures to exclude details such as position of components and certain precise connections between such components when such details are unnecessary for a complete understanding of how to make and use the invention. Moreover, many of the details, dimensions, angles and other features shown in the Figures are merely illustrative of particular embodiments of the disclosure. Accordingly, other embodiments can have other details, dimensions, angles and features without departing from the spirit or scope of the present invention. In addition, those of ordinary skill in the art will appreciate that further embodiments of the invention can be practiced without several of the details described below.

In the Figures, identical reference numbers typically identify identical, or at least generally similar, elements. To facilitate the discussion of any particular element, the most significant digit or digits of any reference number generally refer to the Figure in which that element is first introduced. Element 110, for example, is first introduced and discussed with reference to FIG. 1.

FIG. 1A is a front isometric view of a coin processing apparatus 100 configured in accordance with an embodiment of the present technology. The apparatus 100 can be used with a wide variety of coin counting machines, coin sorting machines, or machines that both count and sort coins. By way of nonlimiting example, the apparatus 100 and various features thereof can be used with consumer coin counting and/or sorting machines, commercial or industrial coin counting and/or sorting machines, and/or other types of coin (or token) processing machines. Although not shown, the coin apparatus 100 can be housed in a suitable kiosk, cabinet, or other appropriate structure as desired depending on the type of end use intended. In the illustrated environment, the apparatus 100 is configured and/or used as a coin counting apparatus, but in other embodiments the apparatus 100 can be suitably configured and/or used as a coin sorter, or as a coin counter and sorter. Accordingly, for ease of reference the apparatus 100 is referred to herein as a coin "processing" apparatus, with the understanding that the apparatus 100 and various features and structures thereof can be used in various embodiments for coin counting, coin sorting, or for coin counting and sorting, and are not limited to use with any particular type of coin "processing" machine.

Figure 11:
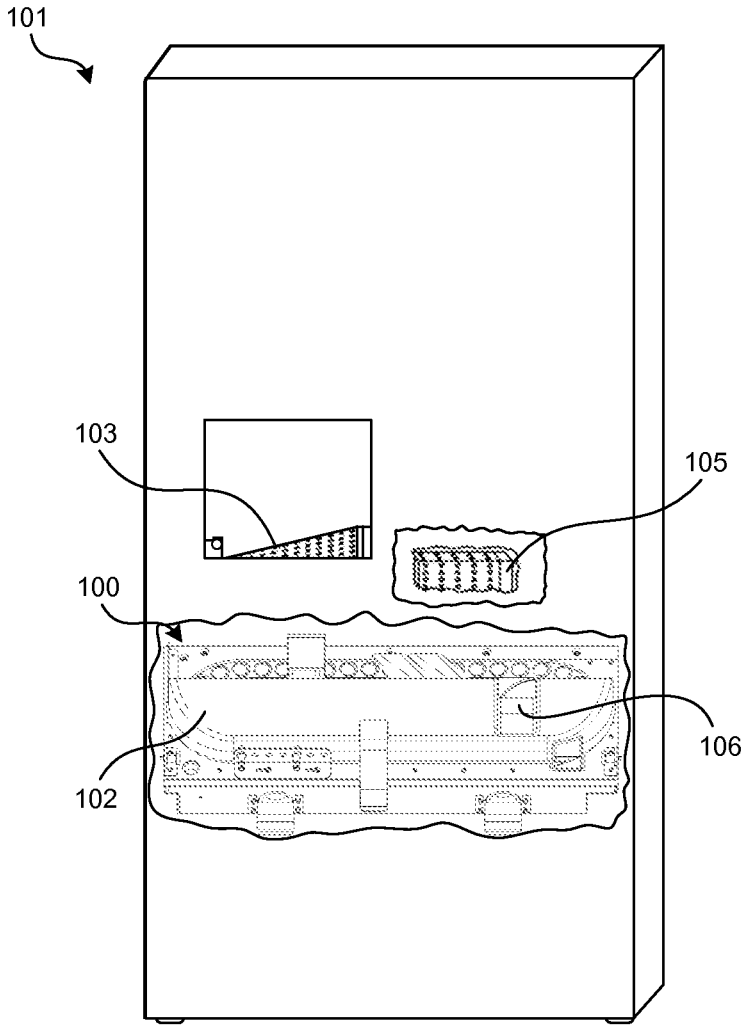
FIG. 11 is a kiosk having a coin counting and/or sorting apparatus configured in accordance with an embodiment of the present technology.

In the illustrated embodiment, the coin processing apparatus 100 (the "apparatus 100") includes a coin receiving portion or hopper 102 attached to the front side of a mounting plate 104. The coin hopper 102 can have smooth walls and be configured to receive batches of random coins for counting (and/or sorting) via a mouth or inlet 106. In various embodiments, the coin inlet 106 can be positioned to receive coins (e.g., cleaned coins) from a coin input region 103 of a consumer coin counting machine kiosk 101 (FIG. 11). The coins can be cleaned (by, e.g., a coin cleaning drum or "trommel" 105) before being transferred into the coin hopper 102 via the inlet 106 in large quantities of random denominations and orientations. Any debris and/or other foreign matter that may nevertheless collect in the hopper 102 can be dispensed via a debris chute 124. The coin hopper 102 can also include one or more sensors for detecting how full the hopper 102 is during operation. For example, the hopper 102 can include a first coin sensor 126*a* (e.g., an electromagnetic inductive proximity switch or other type of known inductive proximity sensor) for detecting when the coin hopper 102 is approximately half full, and a second coin sensor 126*b* for detecting when the hopper 102 is approximately full.

Figure 1B:
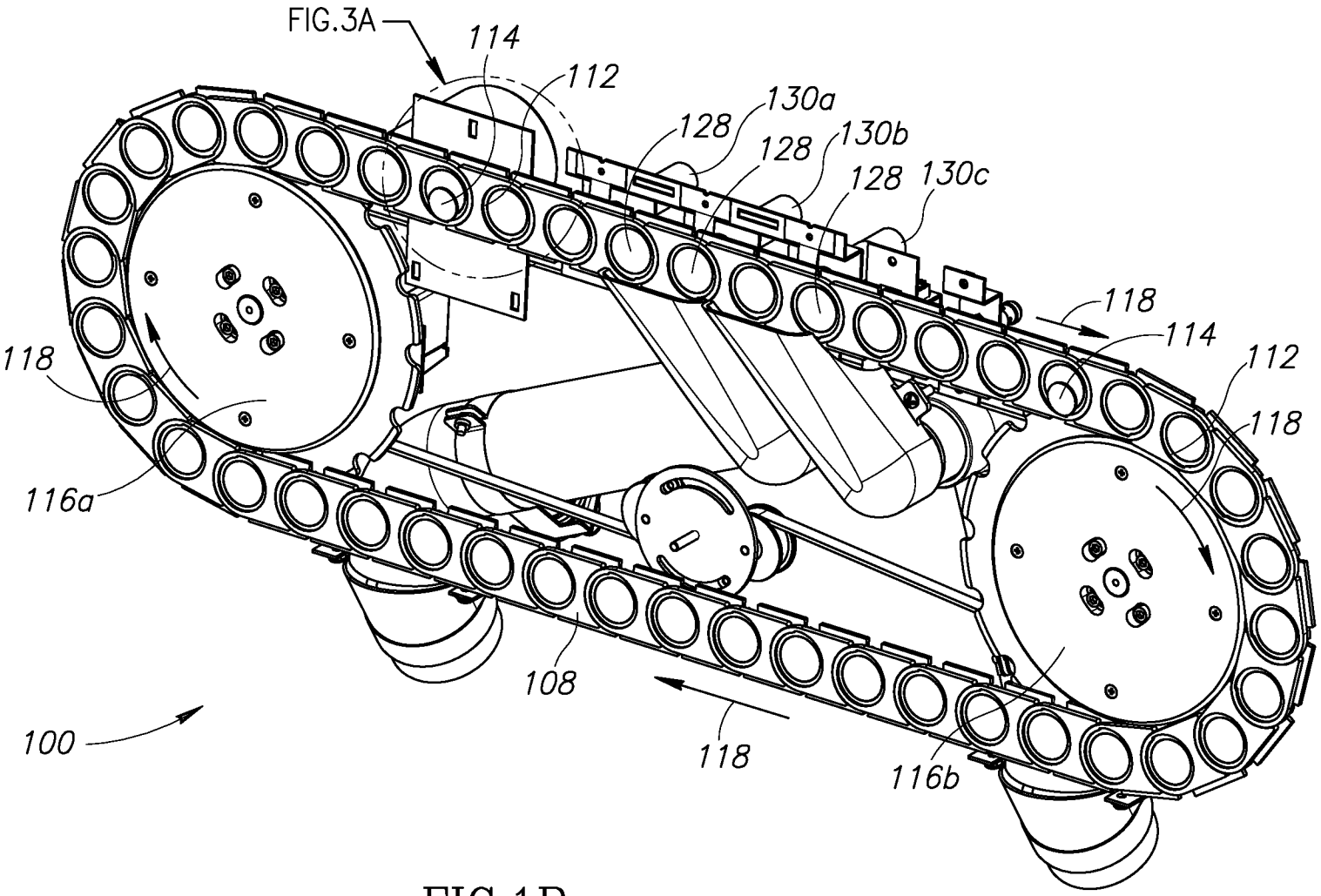
FIG. 1B is a similar isometric view of the apparatus of FIG. 1A with selected structures removed for clarity.

FIG. 1B is a front isometric view of the apparatus 100 with the coin hopper 102 and mounting plate 104 removed for clarity. Referring to FIGS. 1A and 1B together, the apparatus 100 further includes a plurality of coin carriers 110 linked together to form a coin chain or conveyor 108 operably coupled to a first wheel assembly 116*a* (e.g., a "feed" wheel assembly) and a second wheel assembly 116*b* (e.g., a "return" wheel assembly). In the illustrated embodiment, the coin carriers 110 form an endless chain that circulates in an oval path as indicated by the arrows 118 in FIG. 1B when driven by at least one of the wheel assemblies 116. The oval path has a lower segment (e.g., a straight or generally straight lower segment) that extends between the first and second wheel assemblies 116 adjacent to a lower portion of the coin hopper 102. In some embodiments, the lower segment can be from about 10 inches long to about 30 inches long, such as 20 inches long.

As described in greater detail below, in the illustrated embodiment the first and second wheel assemblies 116 include sprockets and accordingly are referred to hereinafter as the first "sprocket assembly" 116*a* and the second "sprocket assembly" 116*b* for ease of reference. As those of ordinary skill in the art will appreciate, however, in other embodiments the wheel assemblies 116 can include pulleys and/or other types of wheels and rotating members for rotatably supporting and/or driving the coin conveyor 108. Some of these other wheel assemblies may include sprockets, while others may not. In yet other embodiments, it is contemplated that all or a portion of the coin conveyor 108 can be directed along an oval-shaped path (or along another path, such as a triangular path) by non-rotating structures, such as a curved track having a relatively low-friction guide surface.

As described in greater detail below, each of the coin carriers 110 includes a corresponding coin pocket 112 configured to carry individual coins (e.g., coins 114) of various denominations (e.g., U.S. 1¢, 5¢, 10¢, 25¢ and 50¢ coins). In the illustrated embodiment, a first coin sensor 132 is mounted to a standoff bracket 134 and directed toward the path of the coin pockets 112 just downstream and proximate the 12 o'clock position of the first sprocket assembly 116*a*. In some embodiments, the first coin sensor 132 can be a camera-based sensor configured to detect a coin image for determining, e.g., coin diameter as the coins move past the sensor 132 in the coin pockets 112. For example, in some embodiments the first coin sensor 132 can be an optical coin sensor, such as the coin sensors described in detail in U.S. patent application Ser. No. 13/489,043, filed Jun. 5, 2012, entitled "OPTICAL COIN DISCRIMINATION SYSTEMS AND METHODS FOR USE WITH CONSUMER-OPERATED KIOSKS AND THE LIKE," and incorporated herein in its entirety by reference. A light source (e.g., an LED or an array of LEDs) can be combined with or positioned proximate the first coin sensor 132 to illuminate the subject coins and facilitate imaging. In one embodiment, for example, a ring of LEDs can be arranged around the first coin sensor 132. In other embodiments, other light sources may be used, or supplemental lighting may be omitted.

The apparatus 100 can further include a second coin sensor (not shown in FIG. 1A or 1B) positioned on the back side of the mounting plate 104 and slightly downstream of the first coin sensor 132. As described below in reference to, e.g., FIG. 4, the second coin sensor can be a suitable electromagnetic sensor configured to detect metallic characteristics (e.g., inductance, etc.) of the coins. As described in greater detail below, in some embodiments the information detected by one or both of the first coin sensor 132 and the second coin sensor can be used to discriminate the coins (e.g., to determine whether multiple coins are disposed in a single pocket 112, to determine coin denomination, to determine whether coins are "acceptable," "frauds," or "unknown," etc.). Suitable image and electromagnetic sensors are known in the art. In other embodiments, however, the various coin handling systems, and structures described herein (e.g., the coin conveyor 108, the coin carriers 110, etc.) can be used with any manner of coin detection or discrimination devices or systems, or indeed, even without any coin discrimination devices. Accordingly, the coin processing apparatuses, systems, and methods described herein are not limited to use with any particular type or arrangement of coin detection, discrimination, counting, and/or sorting system.

In another aspect of this embodiment, a plurality of actuators 130 (identified individually as a first actuator 130*a*, a second actuator 130*b*, and a third actuator 130*c*) can be mounted to the back side of the mounting plate 104. As described in greater detail below, in one embodiment the actuators 130 can be solenoids that respond to electronic signals to drive coin movers or plungers 128 outwardly from their corresponding coin pockets 112 to knock coins out of the pockets 112 at an appropriate time depending on how the coins have been discriminated by the first coin sensor 132 and the second coin sensor. Such solenoids are commercially available from various sources including, for example, Johnson Controls, Inc. of 5757 N. Green Bay Ave., Milwaukee, Wis. 53201. Depending on which of the actuators 130 is activated, the coins 114 can be knocked out of their corresponding pocket 112 and into either a coin return chute 122 that returns the coins to the user, or into a first coin acceptance chute 120*a* or a second coin acceptance chute 120*b* that directs the coins to, e.g., a corresponding holding bin. In other embodiments, the actuators 130 can be other types of devices (e.g., electro-mechanical devices) for imparting motion (via, e.g., a pushrod) to the plungers 128 in response to, e.g., an electronic signal.

Figure 2A:
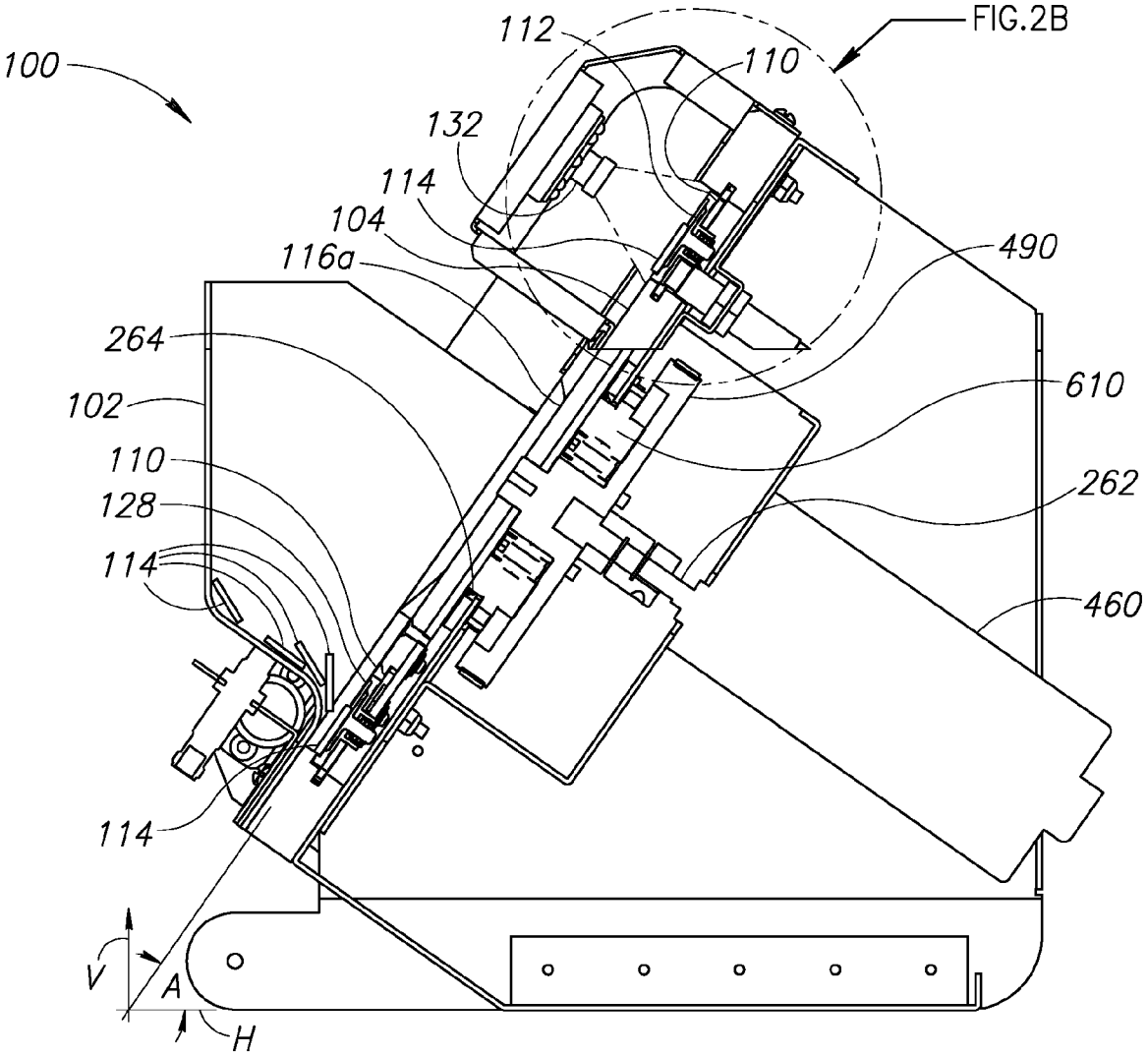
FIG. 2A is a side cross-sectional view taken substantially along line 2A-2A in FIG. 1A.
Figure 2B:
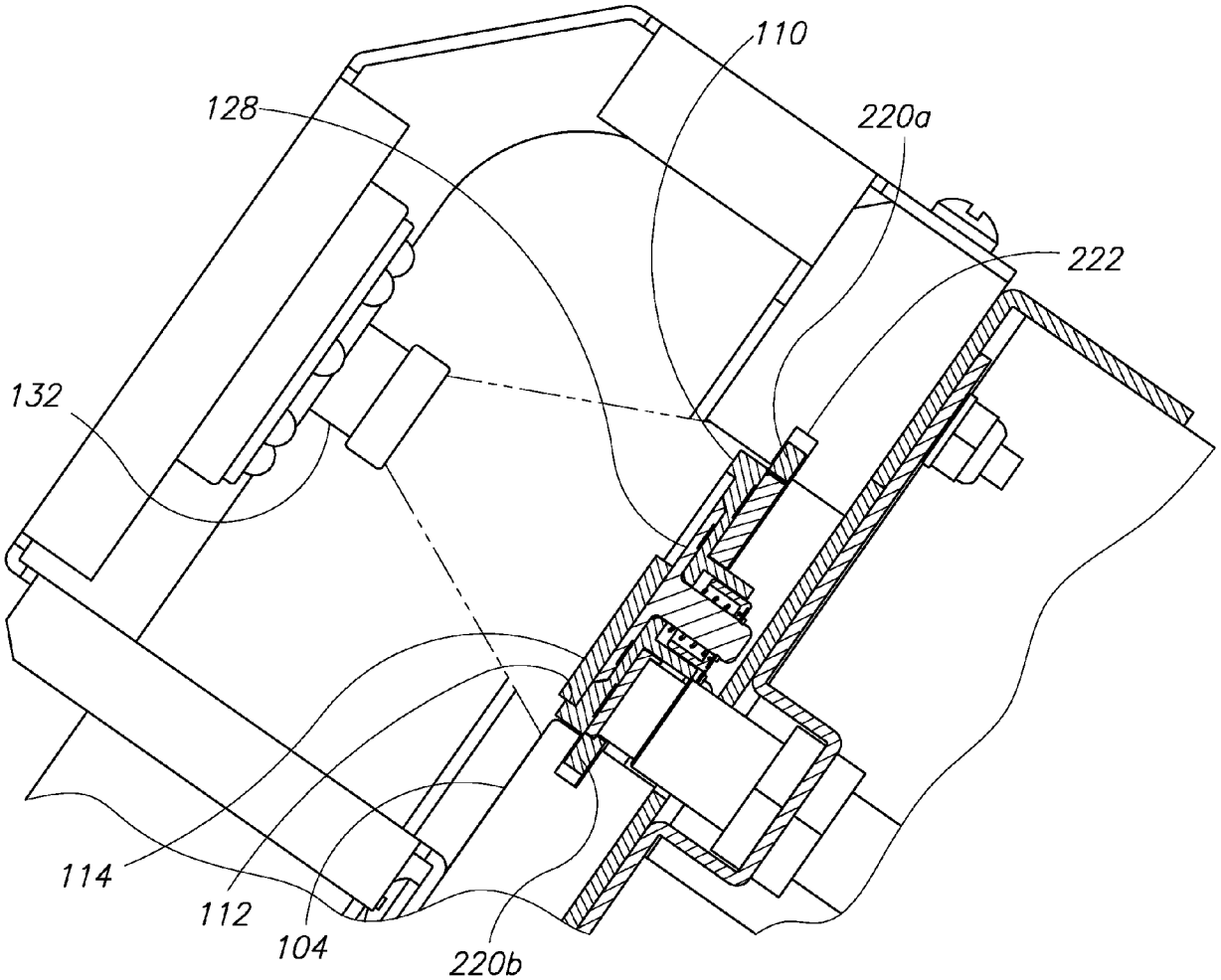
FIG. 2B is an enlarged side cross-sectional view taken from FIG. 2A.

FIG. 2A is a cross-sectional side view taken substantially along line 2A-2A in FIG. 1A, and FIG. 2B is an enlarged portion of FIG. 2A illustrating the arrangement of the first coin sensor 132 in more detail. Referring first to FIG. 2A, the mounting plate 104 is positioned at an angle A relative to a horizontal plane or axis H. The angle A can be from about 40 degrees to about 80 degrees, such as from 40 degrees to 70 degrees, or about 50 degrees. The angle A enables the coins 114 in the hopper 102 to fall into the coin pockets 112 in the coin carriers 110 as the coin carriers 110 move laterally across a lower portion of the coin hopper 102. The coin carriers 110 carry the individual coins upward around the first sprocket assembly 116*a* and into the field of view of the first coin sensor 132.

Referring to FIGS. 2A and 2B together, as mentioned above the first coin sensor 132 of the illustrated embodiment can be an optical sensor positioned to obtain an image of each of the coins 114 as they pass by on the respective coin carriers 110. In one aspect of this embodiment, an optical or camera-based sensor is used because an electromagnetic coin sensor may not be able to distinguish between a single large coin and two smaller coins in the same coin pocket 112. Conversely, a camera-based coin sensor can be configured to detect an image and quickly distinguish the shape of multiple coins from a single coin. In the event that the first coin sensor 132 detects multiple coins 114 in a single coin pocket 112, the corresponding plunger 128 can be actuated at an appropriate time as described in greater detail below to knock the multiple coins back into the hopper 102 so that they can be individually picked up and properly examined.

As shown to good effect in FIG. 2B, each of the coin carriers 110 includes a first guide flange 220*a* and a second guide flange 220*b* extending along the opposing edges of the coin carrier 110. The guide flanges 220 are slidably received in corresponding slots 222 formed by or in the mounting plate 104. The guide flange 220/slot 222 configuration enables the coin carriers 110 to slide smoothly around the oval path in the mounting plate 104 during operation of the apparatus 100.

Figure 3A:
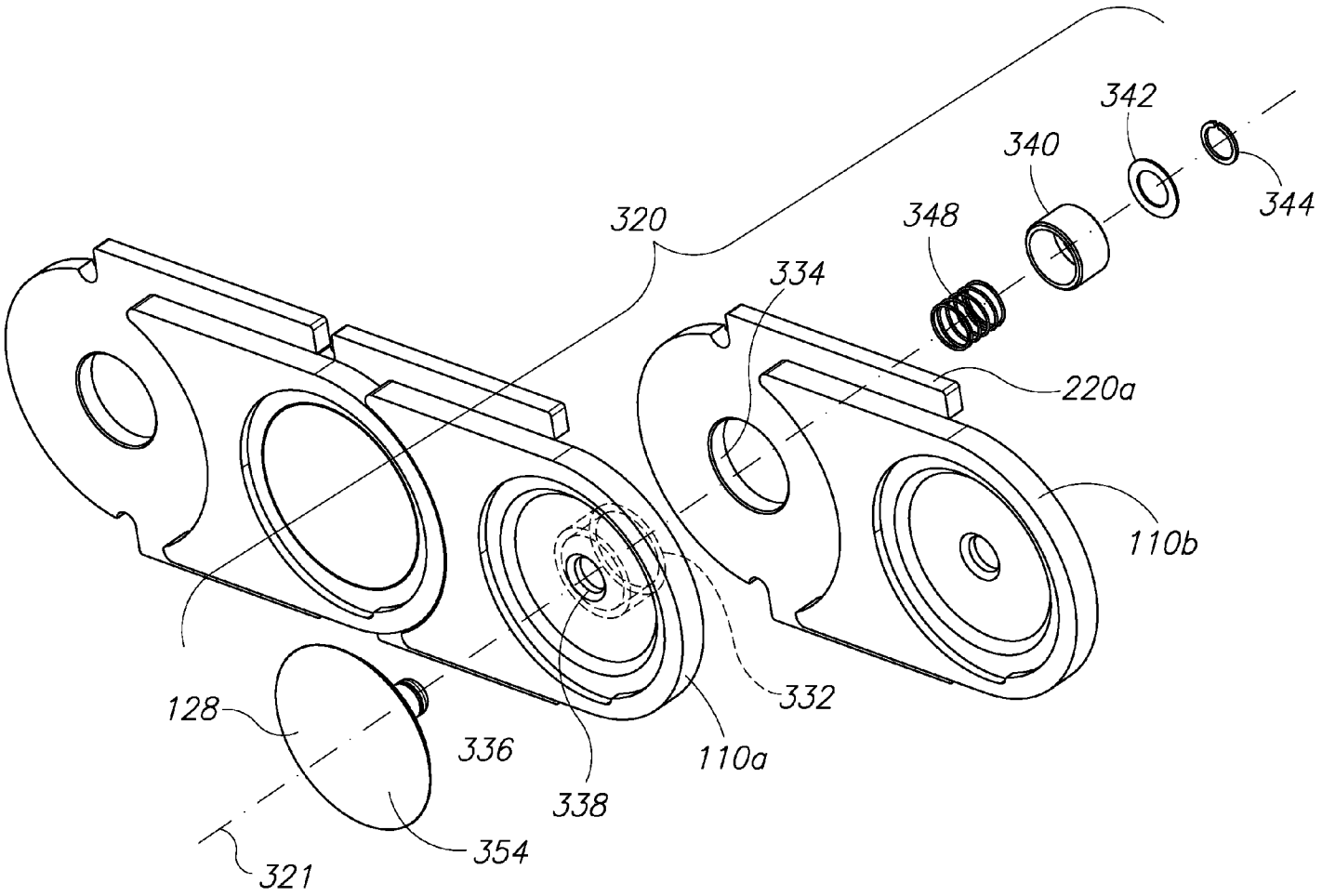
FIG. 3A is a partially exploded isometric view of a portion of a coin conveyor configured in accordance with an embodiment of the present technology.
Figure 3B:
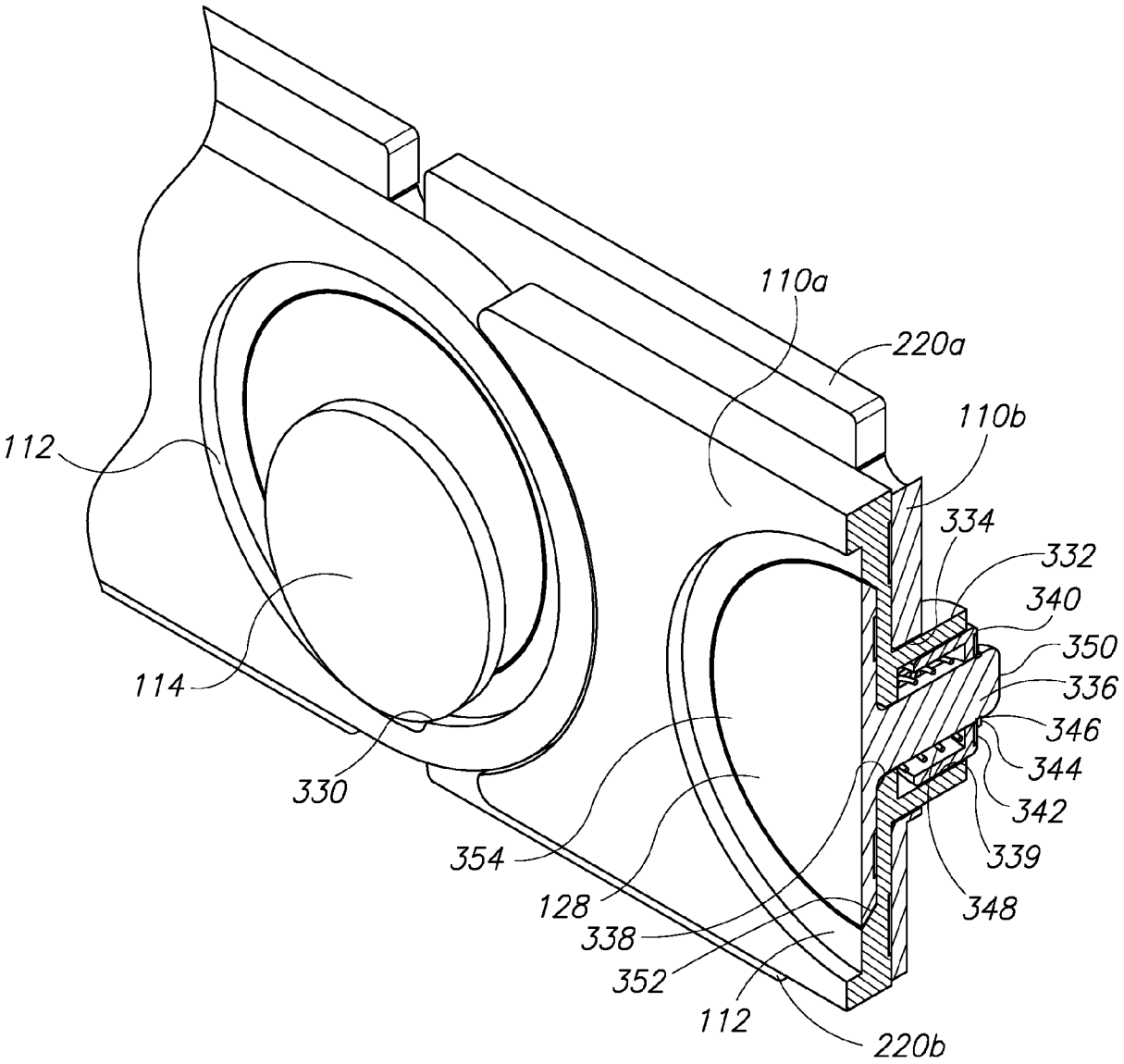
FIGS. 3B and 3C are enlarged isometric cross-sectional views of the coin conveyor of FIG. 3A illustrating operation of an associated coin plunger in accordance with an embodiment of the present technology.
Figure 3C:
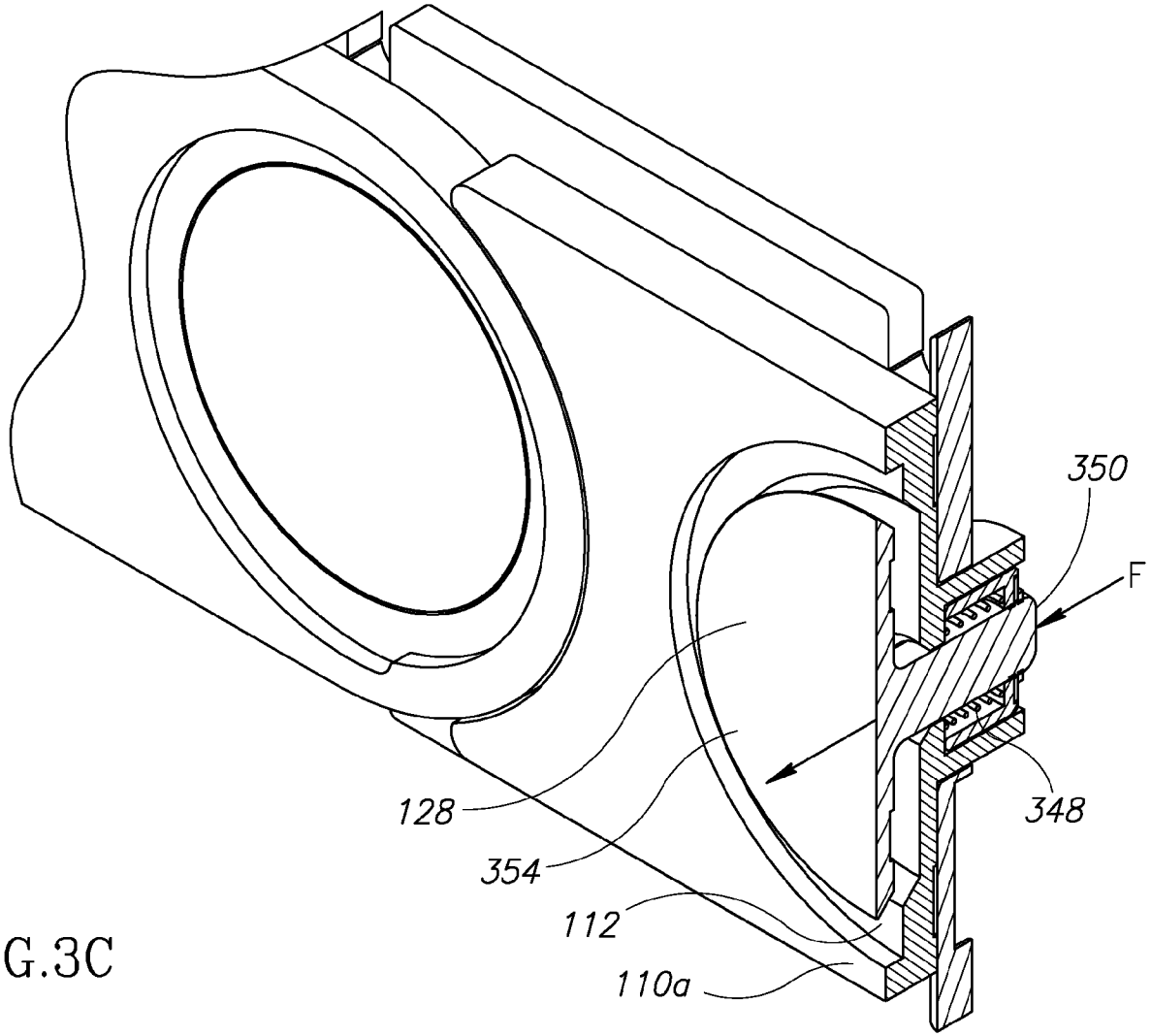

FIG. 3A is an exploded isometric view of a pair of adjoining coin carriers 110 (identified for ease of reference as a first coin carrier 110*a* and a second coin carrier 110*b*) and an associated plunger assembly 320, configured in accordance with an embodiment of the present technology. FIGS. 3B and 3C are enlarged cross-sectional side views illustrating the pivotal connection between the first coin carrier 110*a* and the second coin carrier 110*b*, as well as operation of the coin plunger 128, respectively, in accordance with another embodiment of the present technology. Referring first to 3A, in one aspect of the illustrated embodiment, each of the coin carriers 110 can be identical, or at least substantially identical, to each other. The carriers 110 can be manufactured from ultra-high molecular weight (UHMW) polyethylene, such as black or dark-colored polyethylene, to provide visual contrast between the coins and the coin carriers 110 and facilitate effective imaging by the first coin sensor 132. Moreover, the use of UHMW polyethylene reduces friction between the coin carriers 110 and the mounting plate 104 and enables smooth operation of the coin conveyor 108 as it circulates about the first and second sprocket assemblies 116.

Referring next to FIG. 3B, in one embodiment the coin pocket 112 can be sized to receive and carry the range of valued coins from the smallest desired coin, such as a U.S. dime, to the largest desired coin, such as a U.S. 50¢ piece.

Additionally, although the coin pocket 112 can be generally round, the outer wall of the coin pocket 112 can include a coin stabilizing feature along a bottom portion thereof, such as a ridge 330 that supports the coin 114 at two points and generally prevents the coin from rocking as it moves past the respective coin sensors.

Referring to FIGS. 3A and 3B together, each coin carrier 110 (e.g., the first coin carrier 110*a*) interconnects with an adjacent coin carrier 110 (e.g., the second coin carrier 110*b*) by means of a cylindrical protrusion or boss 332 that, in the illustrated embodiment, extends toward the back side of the apparatus 100. For example, the boss 332 on the first coin carrier 110*a* is rotatably received in a corresponding bore 334 in the second coin carrier 110*b* to pivotally link the first coin carrier 110*a* to the second coin carrier 110*b* about an axis 321. The coin plunger 128 includes a stem 336 extending rearward from a circular head portion 354. The stem 336 slidably extends through a central first bore 338 in the boss 332. The plunger assembly 320 further includes a biasing member 348 (e.g., a coil spring) operably disposed around the stem 336 and within a cylindrical cap 340. The cap 340 is slidably disposed within a second bore 339 in the boss 332, and compresses the biasing member 348 against a rear surface of the first coin carrier 110*a* adjacent the first bore 338. The cap 340 is held in place by a keeper 342 (e.g., a flat washer or similar annular member) that is retained by a clip 344 (e.g., a circlip) that is received in a groove 346 formed circumferentially in a distal end portion 350 of the stem 336. As these views illustrate, in the illustrated embodiment the adjacent coin carriers 110 are held in pivotal connection by alignment of the adjacent guide flanges 220 in the slots 222 in the mounting plate 104 (FIG. 2B).

As shown in FIG. 3B, compressing the biasing member 348 against the cap 340 biases the outer edge of the plunger head 354 against a beveled seat 352 in the first coin carrier 110*a*. When biased in this manner, the forward-facing surface of the plunger head 354 remains generally flush with the adjacent surface of the coin pocket 112. As shown in FIG. 3C, however, when a force is applied to the distal end portion 350 of the plunger 128 in a direction F (via, for example, one of the actuators 130 (FIG. 1B)), the force compresses the cap 340 against the biasing member 348 and momentarily drives the plunger head 354 outwardly, away from the seat 352. This action knocks any coin residing in the coin pocket 112 out of the pocket 112. Upon removal of the force, the biasing member 348 immediately drives the plunger head 354 back against its seat 352 so that the coin pocket 112 can receive another coin as it circulates through the coin hopper 102.

Figure 4:
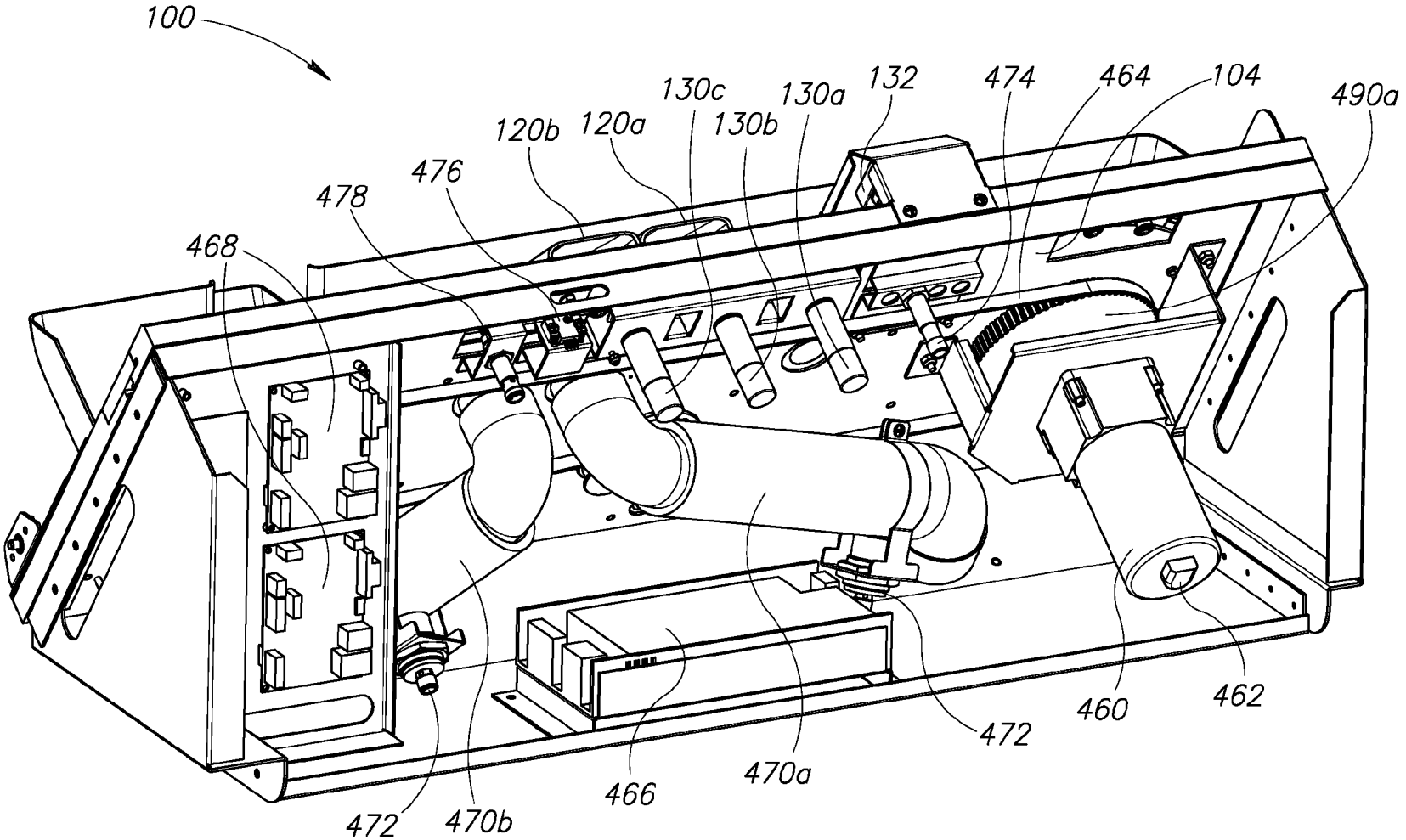
FIG. 4 is a rear isometric view of the coin counting and/or sorting apparatus of FIG. 1A configured in accordance with an embodiment of the present technology.

FIG. 4 is a rear isometric view of the apparatus 100 configured in accordance with an embodiment of the present technology. In the illustrated embodiment, a motor 460 (e.g., an electric motor) is mounted to the back side of the mounting plate 104 and operably coupled to a first pulley 490*a* (e.g., a toothed pulley) by a drive shaft (not shown in FIG. 4). In some embodiments, the motor 460 can be a 12 or 24 VDC gear motor (bidirectional), having an output shaft capable of, for example, approximately 40 in/lbs torque and 65 or more RPM at 100% PWM. Such motors are commercially available from, for example, the Crouzet corporation. The first pulley 490*a* is coupled to a second pulley 490*b* (also not shown in FIG. 4) by a drive member 464. In the illustrated embodiment, the drive member 464 is a flexible timing belt, such as a toothed belt of reinforced rubber construction. In other embodiments, other types of suitable drive members known in the art (e.g., chains, gears, etc.) can be used to couple the first and second pulleys 490 together. Such drive members can provide a "timing" function via gear teeth, belt teeth, etc. so that the first and second pulleys 490 move in unison and/or are synchronized.

In operation, the motor 460 rotates the first pulley 490*a*, which in turn rotates the second pulley 490*b* via the drive member 464. As described in greater detail below with reference to FIGS. 5 and 6, each pulley 490*a, b* is part of the corresponding sprocket assembly 116*a, b* (FIG. 1A), so that rotation of the pulleys 490 via the motor 460 rotates the sprocket assemblies 116 and drives the coin conveyor 108 along its operational path. The motor 460 can include an encoder 462 (e.g., an incremental rotary encoder, such as P/N HEDM-5600 B13, from Avago Technologies of 350 West Trimble Road, San Jose, Calif. 95131). As known to those of ordinary skill in the art, the encoder 462 can provide an electrical signal that can be used to monitor and/or control the speed and/or position of the motor drive shaft. Accordingly, the encoder 462 can monitor the speed, position, and/or other operational parameters of the motor output and make adjustments if necessary to maintain or provide desired movement of the coin conveyor 108 (FIG. 1A).

The apparatus 100 can include a power source 466 (e.g., a transformer, battery, etc.) for providing power (e.g., facility electrical power) to the motor 460. Additionally, the apparatus 100 can include a controller 468 (e.g., a programmable logic controller (PLC) or a printed circuit board (PCB) carrying various processing and/or memory devices, etc.) for control and operation of the apparatus 100. The controller 468 can include computer-readable storage media that contains computer-executable instructions for causing the various subsystems of the apparatus 100 to perform the operations and methods described herein.

Figure 5:
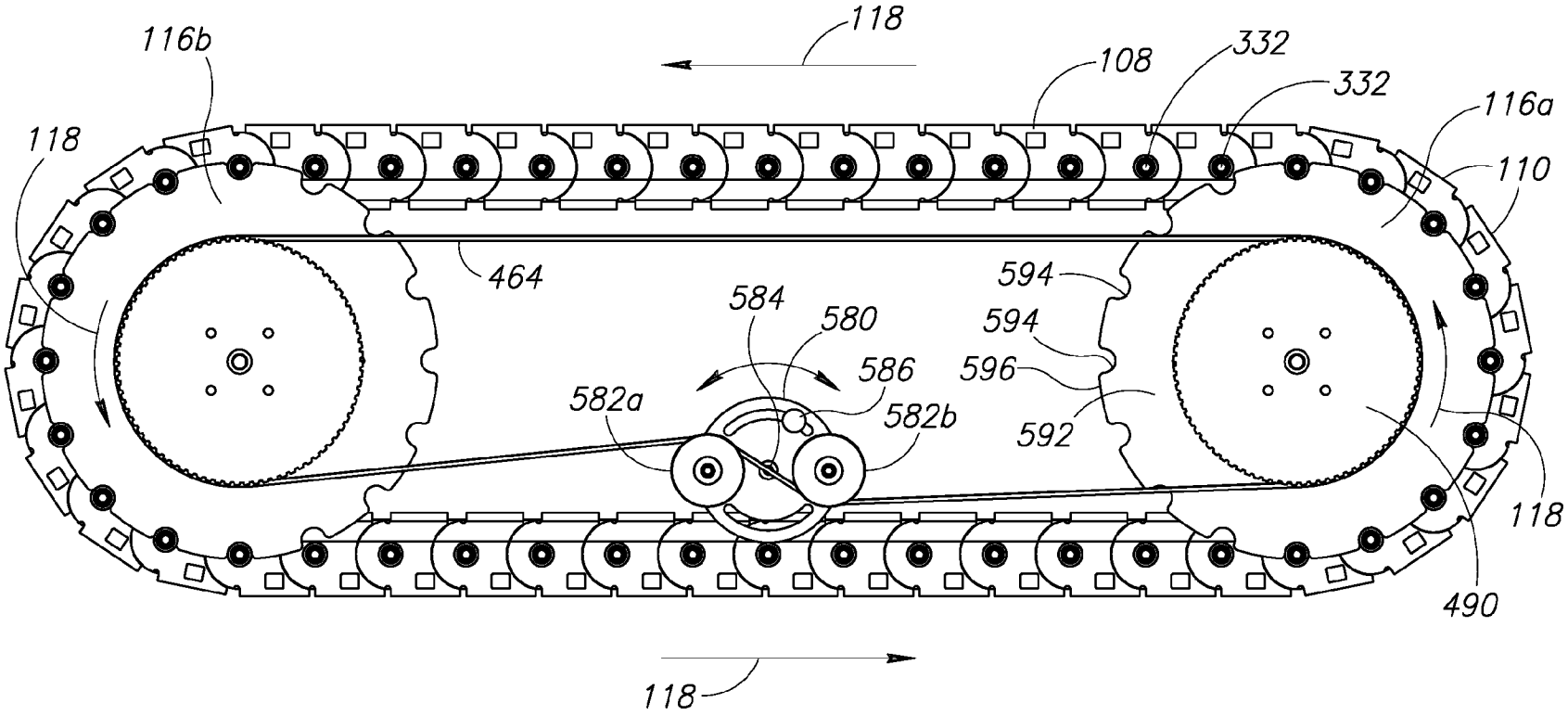
FIG. 5 is a rear view of a coin conveyor and an associated drive system configured in accordance with an embodiment of the present technology.

FIG. 5 is a rear view of a portion of the coin conveying system of the apparatus 100 configured in accordance with an embodiment of the present technology. In the illustrated embodiment, the sprocket assemblies 116*a* and 116*b* are identical, or at least substantially identical, in structure and function, and each includes a sprocket 592 coaxially coupled to a corresponding one of the pulleys 490. The drive member 464 wraps around each of the pulleys 490 and can pass through a tensioner 580. In the illustrated embodiment, the tensioner 580 includes a first pulley or roller 582*a* and a second roller 582*b*. The rollers 582 are rotatably mounted to the tensioner 580 in diametrically opposed positions relative to a central axis 584. The operating tension in the drive member 464 can be adjusted as desired by rotating the tensioner 580 about the central axis 584 to either increase or decrease the tension in the drive member 464. For example, if the tensioner 580 is rotated in a clockwise direction, the tension in the drive member 464 will increase. Conversely, rotation of the tensioner 580 in the counter-clockwise direction reduces the tension in the drive member 464. Once the desired tension has been achieved, the tensioner 580 can be fixed to, e.g., the mounting plate 104 with one or more fasteners 586 extending through arcuate adjustment slots, or with other types of tightening features.

Each of the sprockets 592 includes a series of equally spaced-apart teeth 596. Between each tooth 596 is a corresponding notch 594 configured to receive the bosses 332 from the coin carriers 110. In operation, the motor 460 (FIG. 4) drives both sprocket assemblies 116 by applying power to the first pulley 490*a*, which in turn drives the second pulley 490*b* via the drive member 464. As the sprocket assemblies 116 rotate in, for example, the direction indicated by the arrows 118, the first and second sprockets 592 drive the coin conveyor 108 in an oval path by engaging the bosses 332 on each of the coin carriers 110.

Figure 6:
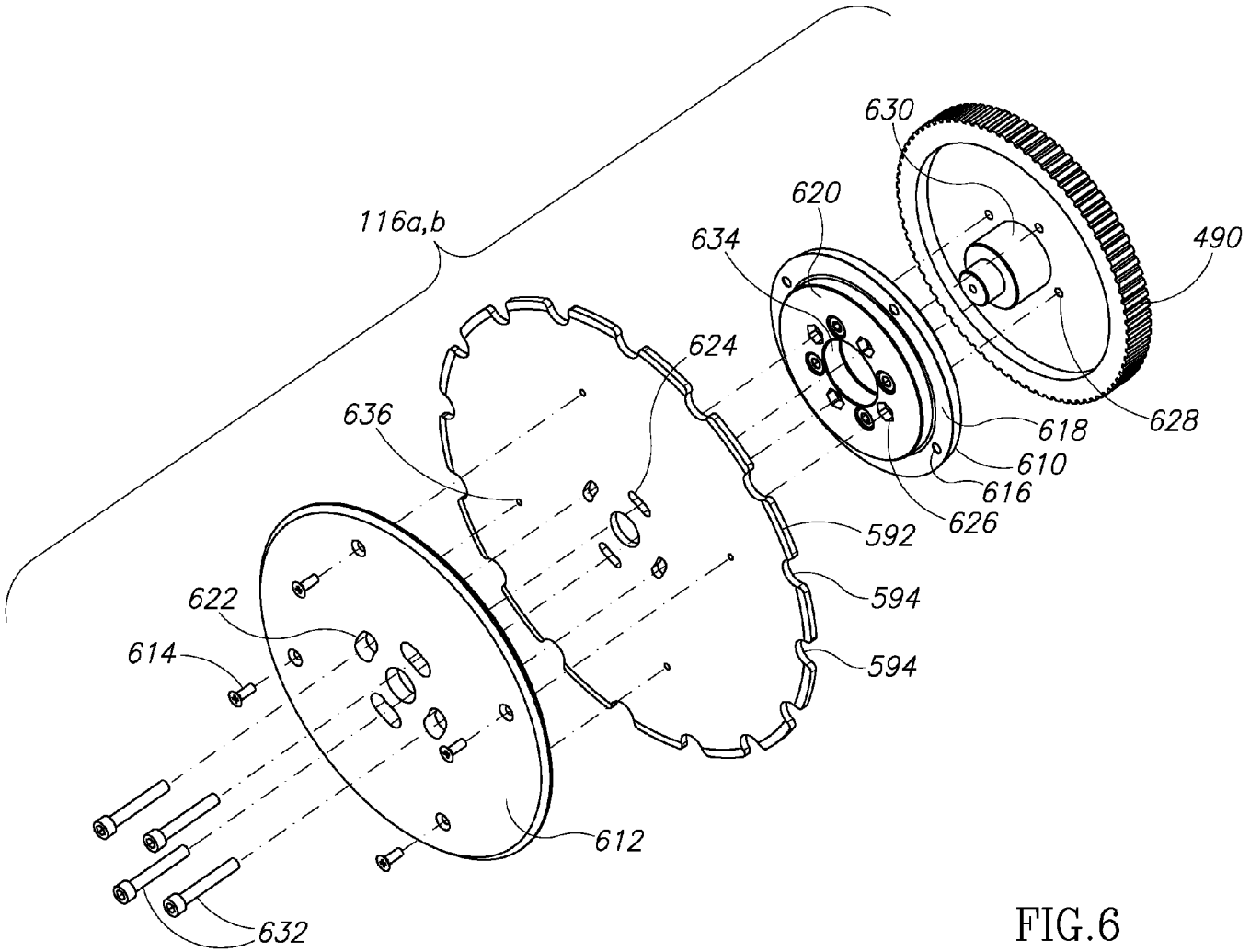
FIG. 6 is an exploded isometric view of a coin conveyor sprocket assembly configured in accordance with an embodiment of the present technology.

FIG. 6 is an exploded isometric view of the sprocket assembly 116 configured in accordance with an embodiment of the present technology. In the illustrated embodiment, the pulley 490 mounts to one side of a slew bearing 610, and the sprocket 592 and an adjoining face plate 612 mount to the opposite side of the slew bearing 610. The pulley 490 can include a central boss 630 that protrudes through a corresponding central aperture 634 in a hub 620 of the slew bearing 610. The slew bearing hub 620 can rotate with respect to an outer flange 618 that has a plurality of spaced-apart fastener holes 616. The sprocket 592, the pulley 490, the face plate 612, and/or the slew bearing 610 can be procured from suitable commercial sources or made from various suitable materials known in the art, include various metallic materials, such as aluminum, stainless steel, etc, and/or non-metallic materials, such as plastic, UHMW polyethylene, etc.

Referring to FIG. 2A together with FIG. 6, to install the first sprocket assembly 116*a* on the apparatus 100, the slew bearing hub 620 is inserted through an aperture 264 in the mounting plate 104. The slew bearing 610 is secured in place by a plurality of fasteners (not shown) that extend through the mounting plate 104 and thread into the holes 616 in the outer flange 618 of the slew bearing 610. The face plate 612 is mounted to the sprocket 592 by a plurality of fasteners 614 (e.g., screws) that extend through holes in the face plate 612 and thread into corresponding holes 636 in the sprocket 592. A plurality of elongate fasteners 632 (e.g., socket head fasteners) are extended through elongate or arcuate holes 622 in the face plate 612, through corresponding elongate holes 624 in the sprocket 592, and then through holes 626 in the slew bearing hub 620. The fasteners 632 are then threaded into holes 628 formed in the pulley 490 to sandwich the forgoing components together with the face plate 612 and the sprocket 592 on the front side of the mounting plate 104, and the pulley 490 on the back side of the mounting plate 104. Before the fasteners 632 are fully torqued, however, the sprocket 592 can be rotated fore or aft relative to the fasteners 632 by means of the elongate holes 622 and 624 to increase or decrease tension in the coin conveyor 108 as desired. The tension in either the upper segment of the coin conveyor 108 or the lower segment of the coin conveyor 108 can be increased or decreased depending on the way the sprocket 592 is rotated relative to the slew bearing hub 620. Once the desired conveyor tension is achieved, the fasteners 632 can be fully torqued to secure the sprocket 592 to the front side of the slew bearing hub 620 and the pulley 490 to the back side of the slew bearing hub 620. As shown in FIG. 2A, the motor 460 can then be operably coupled to the pulley 490 via a drive shaft 262 that centrally engages the pulley 490.

Figure 7A:
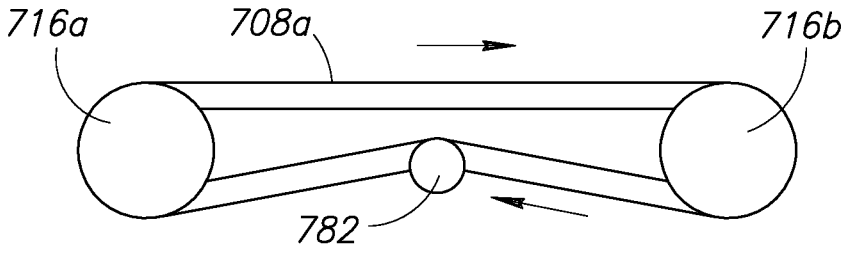
FIGS. 7A-7C are a series of schematic views illustrating various embodiments of coin conveyors configured in accordance with the present technology.
Figure 7B:
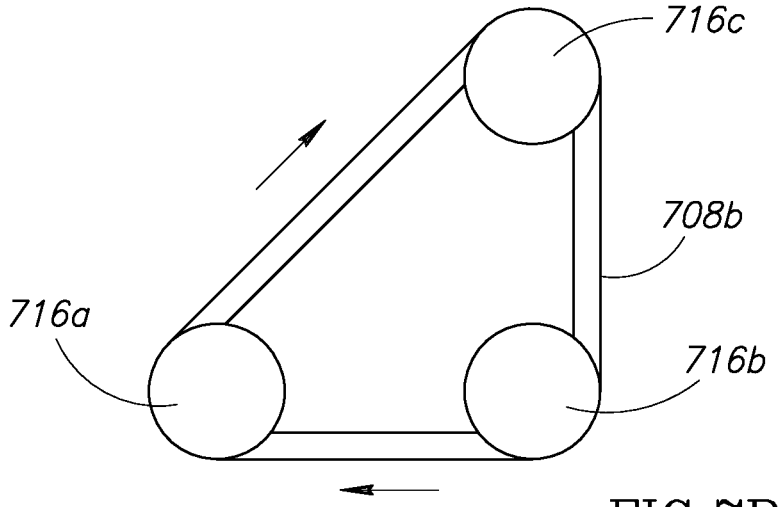
Figure 7C:
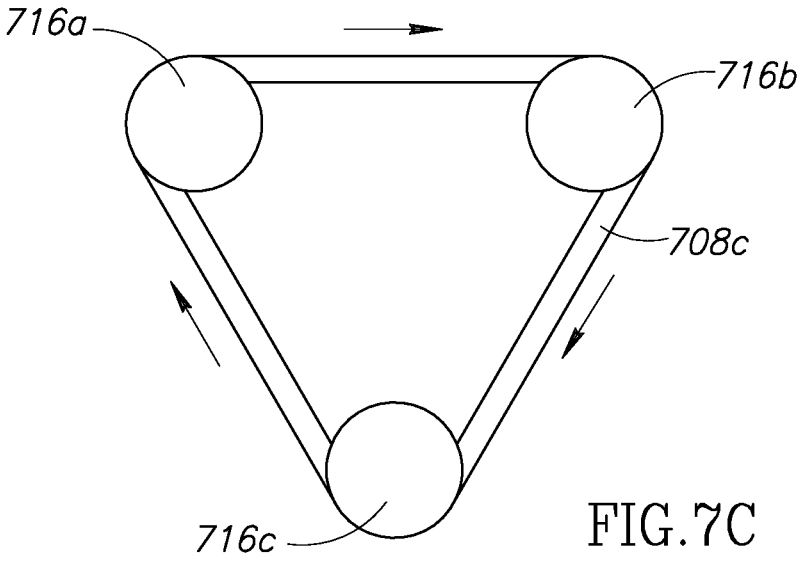

Although FIG. 5 illustrates one configuration of coin conveyor configured in accordance with the present technology, in other embodiments coin conveyor systems can have different geometries in accordance with the present technology. FIGS. 7A-7C, for example, are schematic views illustrating a series of different coin conveyor geometries configured in accordance with the present technology. FIG. 7A, for example, illustrates a coin conveying system having a coin conveyor 708*a* that travels along a path having a generally horizontal upper segment (e.g., a straight or generally straight upper segment) extending between two horizontally spaced-apart sprockets 716*a* and 716*b*. In this particular embodiment, however, the coin conveyance system further includes a roller or pulley 782 disposed between the first sprocket 716*a* and the second sprocket 716*b*. In operation, the pulley 782 forms an apex in the lower portion of the coin conveyor path. In one aspect of this embodiment, the pulley 782 can have a vertically adjustable position for altering the tension in the coin conveyor 708*a* as desired. FIGS. 7B and 7C illustrate triangular arrangements of sprocket assemblies 716*a*-716*c* that cause the respective coin conveyors 708*b* and 708*c* to move in triangular, rather than oval, paths. Accordingly, as the foregoing examples illustrate, various types of non-gravity-based coin conveyor systems can be configured in accordance with the present technology to move coins along various paths past coin sensors, actuators, etc. for counting and/or sorting coins.

Returning to FIGS. 1B and 4 together, a number of devices are positioned along an upper portion of the mounting plate 104 to sense and/or discriminate various features of coins traveling on the coin conveyor 108 after they have been lifted from the coin hopper 102. As described above, coins moving away from the 12 o'clock position of the first sprocket assembly 116*a* move through a field of view of the first coin sensor 132. The first coin sensor 132 can be an optical sensor that detects the image of the coins to determine, e.g., whether two or more coins are disposed in the coin pocket 112, and/or details of the image of the coin, such as the diameter of the coin.

After moving past the first coin sensor 132, the coins continue in the coin pockets 112 past a second coin sensor 474 mounted to the back side of the mounting plate 104 with a bracket. As described in greater detail below, the second coin sensor 474 can be an electromagnetic coin sensor (e.g., an analog inductive proximity sensor) that detects one or more metallic properties of the coins as they pass by on the coin conveyor 108. Such properties can include, for example, inductance, conductance, qualify factor (Q factor), etc. Various commercially available sensors are suitable for embodiments of the second coin sensor 474, such as the 15-30 VDC sensor, P/N IF6030 from IFM Efector, Inc., of 782 Springdale Drive Exton, Pa. 19341. The metallic content information from the second coin sensor 474 can be used alone or in combination with the geometrical information (e.g., coin diameter) from the first coin sensor 132 to identify the coins as being "acceptable," "reject" (or "unacceptable"), or possibly "unknown."

In another aspect of this embodiment, the actuators 130*a*-*c* are mounted to the back side of the mounting plate 104 with a bracket positioned downstream of the second coin sensor 474. As described in greater detail below, the individual actuators 130 are configured to instantaneously strike the coin plungers 128 (FIG. 3A) in response to electrical signals from the controller 468 to knock coins out of the coin pockets 112 at selected times. For example, in one embodiment the controller 468 can be configured to send actuating signals to the actuators 130 at selected times depending on the different classifications of coins passing by the first coin sensor 132 and the second coin sensor 474. For example, if a coin is classified as a "reject" coin because it has a diameter that is not equivalent to the diameter of a valued coin (e.g., a U.S. 1¢, 5¢, 10¢, 25¢, or 50¢ coin), then the controller 468 can send an actuating signal to the first actuator 130*a* at an appropriate time to strike the plunger 128 of the corresponding coin carrier 110 (FIGS. 3B and 3C) and knock the reject coin into the coin return chute 122 (FIG. 1A) for return to the user/customer.

The second and third coin actuators 130*b* and 130*c* can be used to knock "acceptable" coins off of the coin conveyor 108 and into either the first coin acceptance chute 120*a* or the second coin acceptance chute 120*b* (FIG. 1A). In this embodiment, "acceptable" coins are coins that are recognized by the first coin sensor 132 and/or the second coin sensor 474 as being desired or valued coins. Coins knocked into the first coin acceptance chute 120*a* can pass into a corresponding first coin tube 470*a* and then into a corresponding coin bin (not shown in FIG. 4). Similarly, coins knocked into the second coin acceptance chute 120*b* can pass into a second coin tube 470*b* from where they travel into a corresponding second coin bin (also not shown). Additionally, electromagnetic proximity sensors 472 can be mounted to each of the coin tubes 470 to confirm there is activity in each of the tubes when coins are knocked into the tubes, and also to ensure that neither tube becomes clogged or overflows during operation.

Any "unknown" coins remaining on the coin conveyor 108 after passing the third actuator 130*c* can continue around on the conveyor 108 for a second pass by the coin sensors 132 and 474. In this embodiment, unknown or "recycle" coins may be coins that have a diameter ascertained by the first coin sensor 132 to match a valued coin, but may have other characteristics relating to metal content, for example, that were not fully ascertained by the second coin sensor 474. Recycling unknown coins in this manner provides a "second look" at the coin by the first coin sensor 132 and the second coin sensor 474 to confirm whether the coin is a valued coin that should be kept, or a reject coin that should be returned to the user.

In another aspect of this embodiment, the apparatus 100 further includes a "master link" sensor 476 for recognizing a master link or master carrier on the coin conveyor 108 as it passes by the master link sensor 476. As explained below, the master link can be a carrier similar in structure and function to the coin carriers 110, but with a particular visual or physical feature for distinguishing the master link from the other carriers 110. The master link sensor 476 can be configured to detect the position of the master link and provide this information to the controller 468 so that the controller can determine various factors such as, for example, the speed of the conveyor 108 as well as the relative position of each of the coin carriers 110 at any given time. The apparatus 100 can additionally include a plunger sensor 478 positioned directly adjacent to the path of the distal end portions 350 of the plungers 128 (FIG. 3B) downstream of the master link sensor 476. In one embodiment, the plunger sensor 478 can be configured to sense, e.g., the presence of the metallic keepers 342 (FIG. 3B) on the distal end portions 350 of the plungers 128 as the plungers 128 move past the sensor 478. Information about the presence of the keepers 342 can be sent from the sensor 478 to the controller 468, which can use the information to confirm, for example, the position and functional status of the plunger assemblies 320. Additional aspects of the master link sensor 476 and the plunger sensor 478 are described in detail below with reference to FIG. 8.

Figure 8:
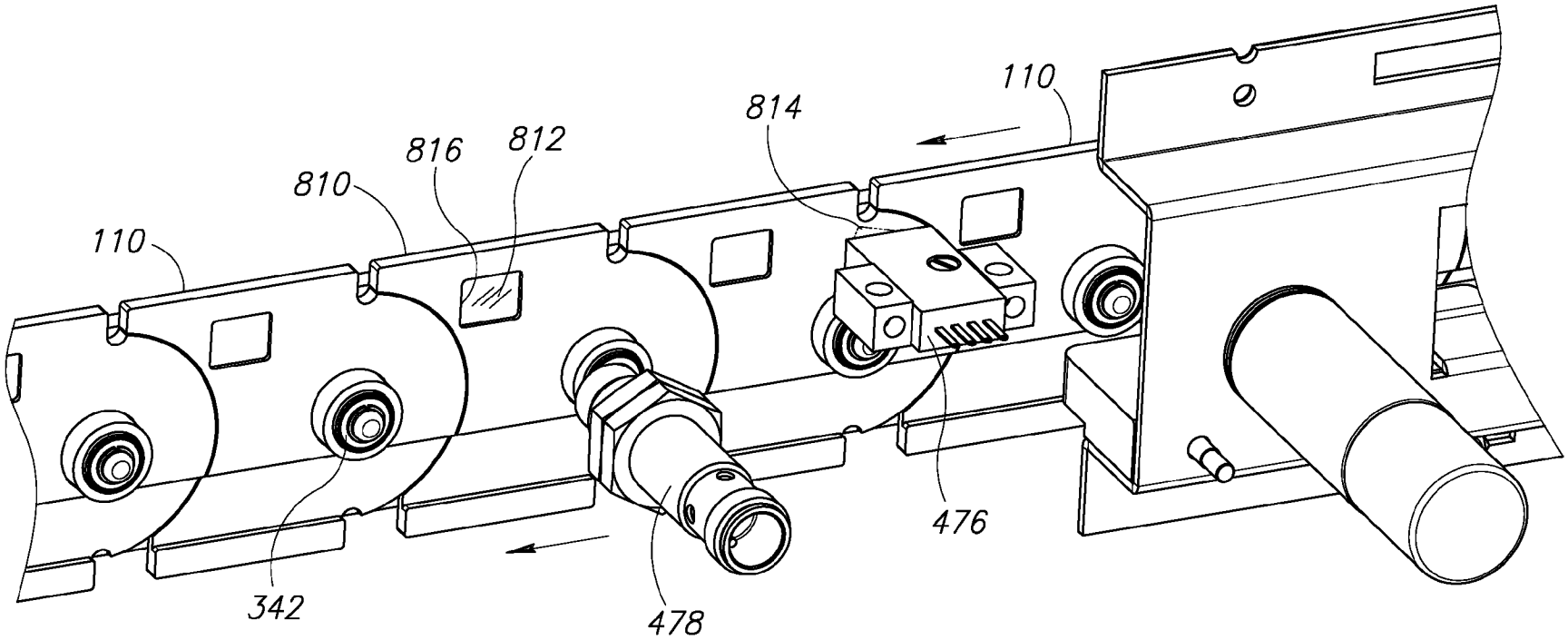
FIG. 8 is an enlarged rear isometric view of a portion of the coin counting and/or sorting apparatus of FIG. 1A illustrating various features associated with operation of the coin conveyor in accordance with an embodiment of the present technology.

FIG. 8 is an enlarged rear isometric view of a portion of the apparatus 100 illustrating an arrangement of the master link sensor 476 and the plunger sensor 478 in accordance with an embodiment of the present technology. The mounting plate 104 has been removed from FIG. 8 for the purposes of illustration. In one aspect of this embodiment, the coin conveyor 108 (FIG. 1A) includes a single master link 810. The master link 810 can be identical, or at least generally similar to, the other coin carriers 110, with the exception that the master link 810 has a target 812 positioned in a window 816. The target 812 (e.g., a visual target, such as a reflective target, reflective window, reflective material, etc.) is positioned so that it passes in a field of view of the master link sensor 476 with each circuit of the coin conveyor 108. In one embodiment, for example, the master link sensor 476 can be an infrared sensor (e.g., a reflective infrared sensor or switch, such as P/N EE-SY672, from Omron Electronics, LLC., of One Commerce Drive, Schaumburg, Ill. 60173). In this embodiment, the sensor 476 utilizes an infrared beam 814 to detect the target 812 as the master link 810 crosses its field of view. This information can be used to determine and adjust various operating parameters of the apparatus 100. For example, information about the time intervals between passages of the master link 810 can be used to monitor and adjust the speed of the coin conveyor 108 if desired. This information can also be used alone and/or in combination with information from the motor encoder 462 (FIG. 4) to ascertain the position of any particular coin carrier 110 on the coin conveyor 108 at any given time. For example, if the first coin sensor 132 and the second coin sensor 474 (FIG. 4) determine that an acceptable coin is positioned in a particular coin pocket 112, information from the master link sensor 476 can be used to time activation of either the second activator 130*b* or the third activator 130*c* to knock the acceptable coin off of the coin conveyor 108 at a desired time so that the coin falls into one of the coin acceptance chutes 120 (FIG. 1).

In another aspect of the illustrated embodiment, the plunger sensor 478 can be an inductive proximity sensor or switch that senses, e.g., the keepers 342 (FIG. 3B) on the distal end portions 350 of the coin plungers 128 as the plungers 128 move past the plunger sensor 478. For example, in some embodiments the sensor 478 can be a 10-36 VDC inductive proximity switch from IFM Efector, Inc., of 782 Springdale Drive Exton, Pa. 19341. Information about the presence of the keepers 342 can be sent from the plunger sensor 478 to the controller 468, which can use the information to confirm that each of the plunger assemblies 320 is properly assembled and functional. This information can also be used either alone and/or in combination with information from the master link sensor 476 and/or information from the motor encoder 462 to determine the position of the individual plunger assemblies 320 relative to the actuators 130*a-c* during operation of the apparatus 100 to ensure that coins are knocked out of the respective coin pockets 112 at the appropriate time.

Figure 9:
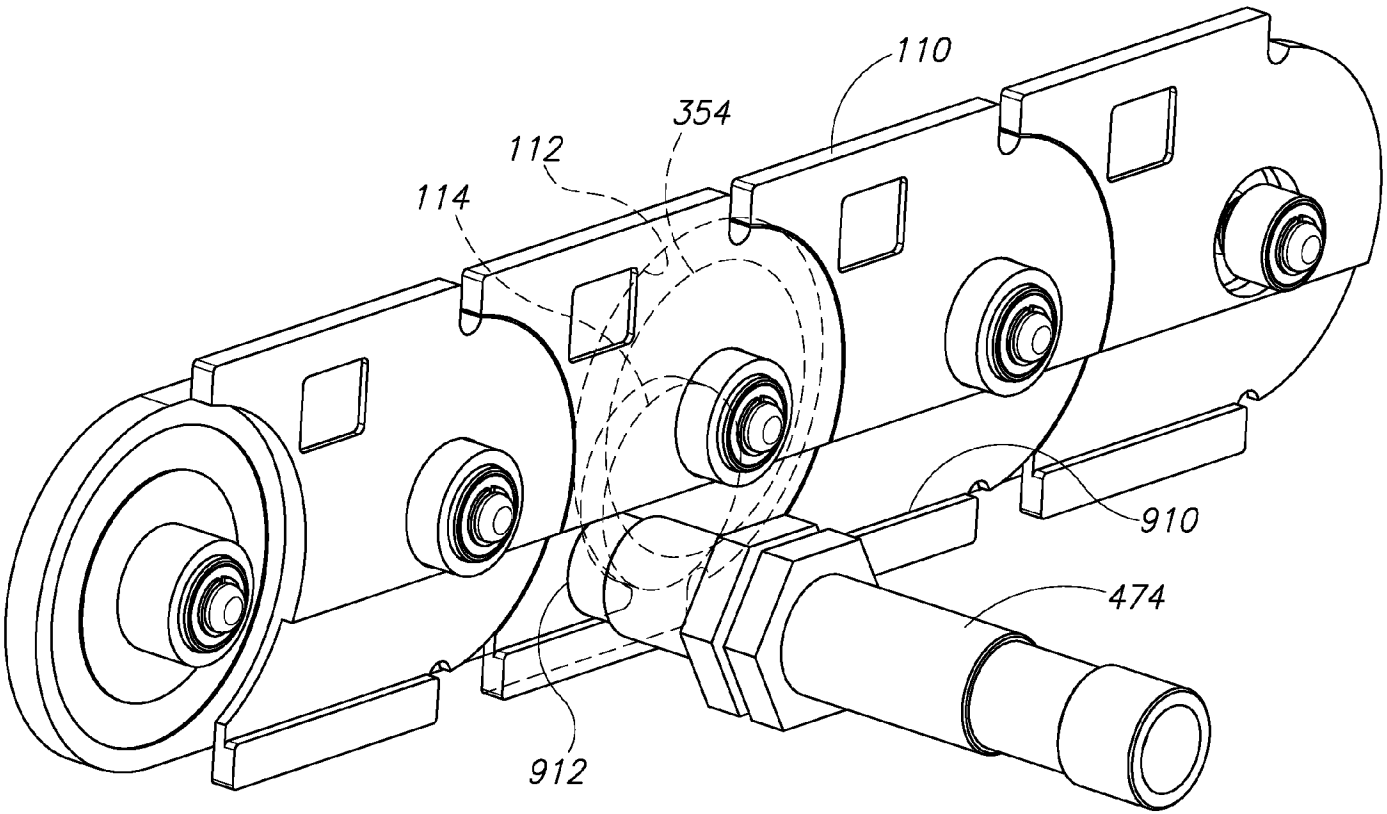
FIG. 9 is an enlarged rear isometric view of another portion of the coin counting and/or sorting apparatus of FIG. 1A illustrating various features associated with discrimination of coins in accordance with an embodiment of the present technology.

FIG. 9 is an enlarged rear isometric view of a portion of the apparatus 100 illustrating an arrangement of the second coin sensor 474 in accordance with an embodiment of the present technology. The mounting plate 104 as well as a mounting bracket for the second coin sensor 474 have been removed from FIG. 9 for purposes of illustration. In one aspect of this embodiment, each of the coin carriers 110 includes a corresponding channel or groove 910 configured to receive a distal end portion 912 of the second coin sensor 474. The groove 910 enables the distal end portion 912 to be positioned relatively close to coins (e.g., the coin 114) carried in the coin pockets 112 on the opposite side of the coin carrier 110 as they pass by the second coin sensor 474. As discussed above, the second coin sensor 474 can be an analog electromagnetic proximity sensor that detects metallic characteristics or properties of the coins. A metallic property or properties of the individual coins as detected by the second coin sensor 474 can be combined with the geometrical characteristics (e.g., the diameter) of the coins as detected by the first coin sensor 132 (FIG. 4) to determine whether a particular coin is an "acceptable" coin or a "reject" coin.

Figure 10A:
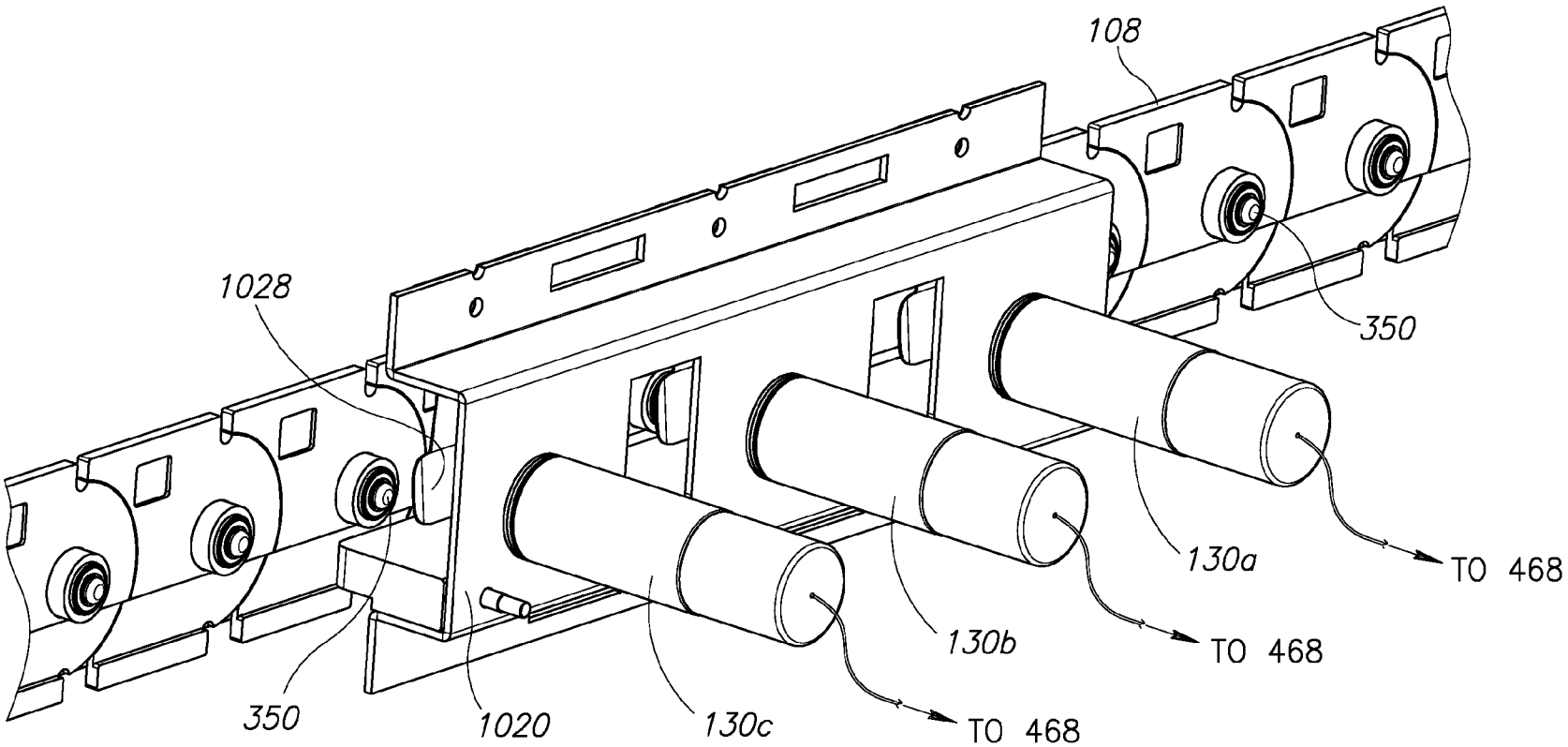
FIG. 10A is an enlarged rear isometric view of yet another portion of the coin counting and/or sorting apparatus of FIG. 1A illustrating various features for displacing coins from the coin conveyor in accordance with an embodiment of the present technology.
Figure 10B:
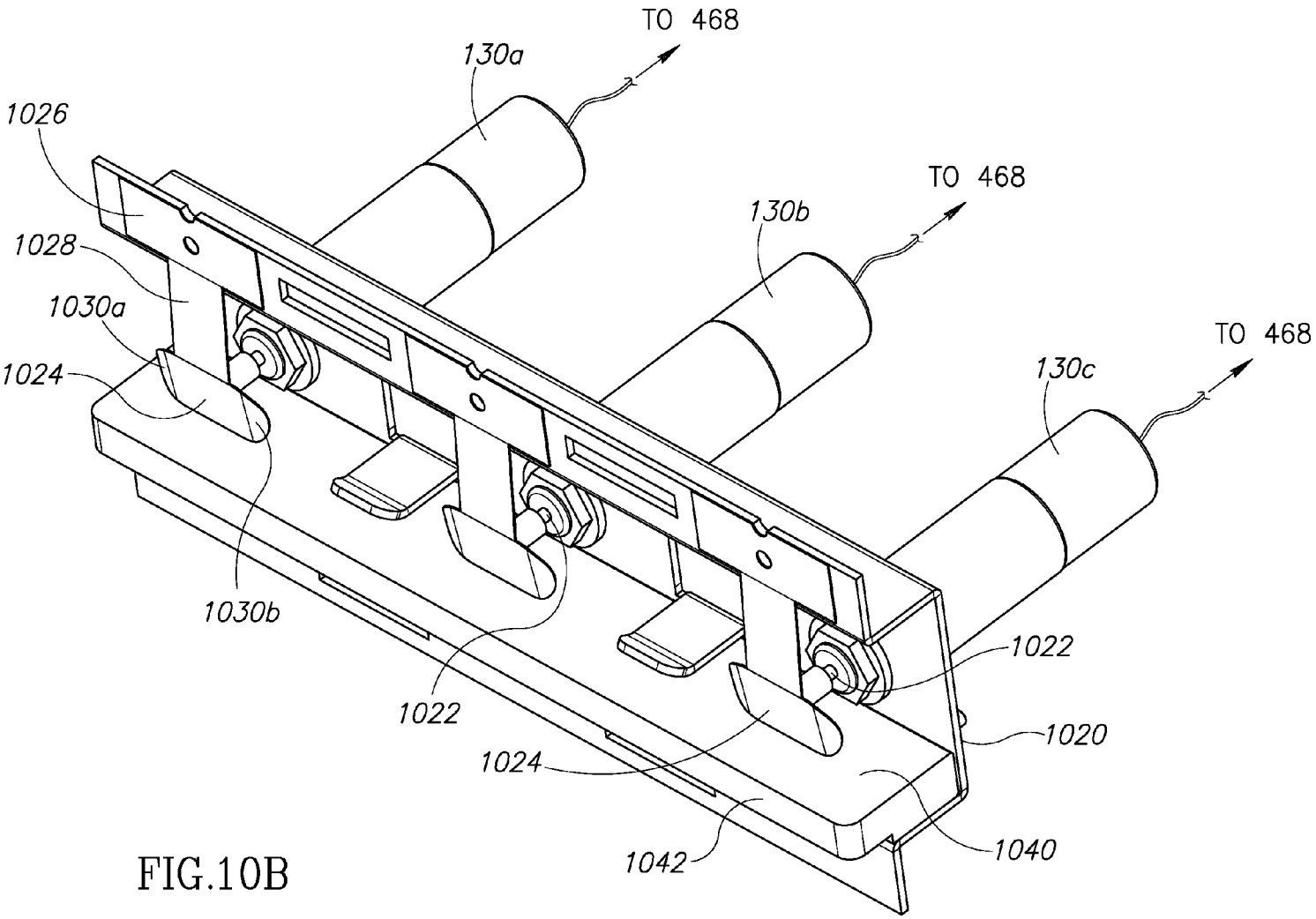
FIG. 10B is an enlarged front isometric view of the features of FIG. 10A.

FIG. 10A is an enlarged rear isometric view of a portion of the apparatus 100 illustrating an arrangement of the actuators 130 in accordance with an embodiment of the present technology. The actuators 130 are mounted in series to a bracket 1020 that is fixedly attached to a back side of the mounting plate 104 (FIG. 4). FIG. 10B is an enlarged front isometric view of the actuator mounting arrangement shown in FIG. 10A. The mounting plate 104 has been removed from FIG. 10A, and the mounting plate 104 and the coin conveyor 108 have been removed from FIG. 10B, for purposes of clarity. Referring to FIGS. 10A and 10B together, in the illustrated embodiment the apparatus 100 further includes a plurality of resilient "fingers" or deflectors 1028 mounted to an upper portion of the bracket 1020 and extending downwardly in front of their respective actuators 130. More specifically, in the illustrated embodiment each deflector 1028 includes an upper proximal portion 1026 fixedly attached to an adjacent upper portion of the bracket 1020 and a lower distal portion having a contact pad 1024. Each contact pad 1024 can include an angled leading edge portion 1030*a* and a similar trailing edge portion 1030*b*. In the illustrated embodiment, each actuator 130 includes a corresponding pushrod 1022 (e.g., a solenoid plunger) positioned directly behind (and/or in contact with) a central portion of each contact pad 1024. Additionally, the central portion of each pad 1024 is also positioned directly adjacent to the path of the distal end portions 350 of the coin carrier plungers 128 (FIGS. 3A-3C). In some embodiments, the deflectors 1028 can be made out of relatively thin gauge resilient steel, such as 301 full hard stainless steel. In other embodiments, the deflectors 1028, or other suitable deflecting members, can be made from other suitable materials including, for example, other resilient materials and other suitable metals, plastics, etc.

In operation, the controller 468 (FIG. 4) can selectively send an electrical signal to any one of the actuators 130 as desired, causing the respective actuator 130 to extend its pushrod 1022 outwardly and momentarily drive the adjacent contact pad 1024 against the distal end portion 350 of the adjacent plunger assembly 320. As shown in FIG. 3C, when the contact pad 1024 is momentarily pushed outward, it exerts a force in direction F on the distal end portion 350 of the coin plunger 128, knocking any coin that may reside in the coin pocket 112 off of the coin carrier 110 and into either one of the coin acceptance chutes 120 or the coin return chute 122 (FIG. 1A).

As shown in FIG. 10B, a press bar 1040 can be mounted to the bracket 1020 beneath the deflectors 1028. In this embodiment, the press bar 1040 has a forward edge portion 1042 that extends into the grooves 910 in the passing coin carriers 110 (FIG. 9). The forward edge portion 1042 is configured to lightly press the coin carriers 110 against the forward sidewall of the slots 222 (FIG. 2B) and stabilize the coin carriers 110, so that when one of the actuators 130 strikes one of the coin plungers 128 on one of the coin carriers 110, it will not upset any of the adjacent coin carriers 110 and inadvertently knock coins of the adjacent coin carriers 110. The press bar 1040 can be made from various suitable materials, such as Delrin®, and in some embodiments springs and/or other biasing members (not shown) can be positioned between the press bar 1040 and the bracket 1020 to resiliently bias the forward edge portion 1042 against the coin carriers 110 at a desired pressure.

Referring to FIGS. 1A-4 together, in operation, a batch of coins of random orientation and denomination can be dispensed into the coin hopper 102 via the inlet 106 from a coin cleaner or other portion of a coin processing machine, such as a consumer or commercial coin counting machine, coin sorting machine, or coin counting and sorting machine. As the coin conveyor 108 circulates in an oval path around the sprocket assemblies 116 and passes through a lower portion of the coin hopper 102, the coins 114 fall or otherwise move into the coin pockets 112 in the individual coin carriers 110 (FIG. 2A). The coin carriers lift the coins in a clockwise direction around the first sprocket assembly 116*a* (FIG. 1B) and into the field of view of the first coin sensor 132. As described above, the first coin sensor 132 can be an image sensor that detects, for example, the outside diameters of the coins. As the coins continue moving from left to right in FIGS. 1A and 1B, they move past the second coin sensor 474 (FIG. 4). As described above, the second coin sensor 474 can be an electromagnetic sensor that determines, for example, metallic characteristics or properties of the coins. Based on the coin size information received from the first coin sensor 132 and the coin metal content information received from the second coin sensor 474, the controller 468 can determine whether an individual coin is an acceptable coin, a reject coin, or perhaps a suspect or "unknown" coin that should be recycled and rechecked. Depending on the classification of each coin, the controller 468 can send a signal to the appropriate actuator 130 that causes the actuator 130 to instantaneously drive the adjacent deflector 1028 (FIG. 10B) against the distal end portion 350 of the adjacent coin carrier plunger 128, thereby driving the plunger 128 momentarily outward from the corresponding coin carrier pocket 112 and knocking the coin out of the coin pocket 112 and into a desired location (FIG. 3C). For example, if the first coin sensor 132 and the second coin sensor 474 determine that a particular coin should be rejected, the controller 468 can send a signal to the first actuator 130*a*, knocking the reject coin into the coin return chute 122. Alternatively, if the coin sensors 132 and 474 determine that the coin is an acceptable coin, the controller 468 can actuate either the second actuator 130*b* or the third actuator 130*c* to knock the coin into either the first coin acceptance chute 120*a* or the second coin acceptance chute 120*b* for subsequent transfer via the corresponding coin tube 470 into a coin collection bin (not shown). Alternatively, if the coin was determined to be a "suspect coin" such that the controller could not sufficiently ascertain the denomination and/or authenticity of the coin, then no actuator 130 is activated, and the coin continues on the coin conveyor 108 back around for a second pass by the first coin sensor 132 and the second coin sensor 474 for a second opportunity to determine the coin's denomination/authenticity. If the coin has not been adequately discriminated after a preset number of passes (e.g., three), then the controller 468 can send a signal to the first actuator 130*a*, knocking the coin into the coin return chute 122.

Various embodiments of the "continuous chain" type coin processing apparatuses described herein can process coins faster than gravity-feed type coin counting or sorting machines that rely on coins rolling or otherwise moving under the force of gravity past a coin sensor. Additionally, because of the relatively high speed of the coin conveyor 108 and the elongate oval shape of the coin path, the apparatus 100 can process a relatively high number of coins per minute, such as from about 680 coins per minute to about 1000 coins per minute. For example, in one embodiment of the apparatus 100, the coin conveyor 108 can have 43 of the coin carriers 110 and can process (e.g. count, sort, or count and sort) 720 coins per minute when the sprocket assemblies 116 rotate at 45 revolutions per minute, or at about 45 revolutions per minute. In yet another aspect of this embodiment, the horizontal spacing of the sprocket assemblies 116 gives the oval coin conveyor path a relatively low profile. This enables the apparatus 100 to be suitably positioned in a counter-type housing or console having a top coin feed position for ease of use by consumers and other users.

Aspects of the invention can be embodied in a special purpose computer or data processor that is specifically programmed, configured, or constructed to perform one or more of the computer-executable instructions explained in detail herein. While aspects of the invention, such as certain functions, are described as being performed exclusively on a single device, the invention can also be practiced in distributed environments where functions or modules are shared among disparate processing devices, which are linked through a communications network, such as a Local Area Network (LAN), Wide Area Network (WAN), or the Internet. In a distributed computing environment, program modules may be located in both local and remote memory storage devices.

Aspects of the invention may be stored or distributed on tangible computer-readable media, including magnetically or optically readable computer discs, hard-wired or preprogrammed chips (e.g., EEPROM semiconductor chips), nanotechnology memory, biological memory, or other data storage media. Alternatively, computer implemented instructions, data structures, screen displays, and other data under aspects of the invention may be distributed over the Internet or over other networks (including wireless networks), on a propagated signal on a propagation medium (e.g., an electromagnetic wave(s), a sound wave, etc.) over a period of time, or they may be provided on any analog or digital network (packet-switched, circuit-switched, or other scheme).

The terminology used herein is to be interpreted in its broadest reasonable manner, even though it is being used in conjunction with a detailed description of certain examples of embodiments of the technology. Indeed, certain terms may even be emphasized below; however, any terminology intended to be interpreted in any restricted manner will be overtly and specifically defined as such in this Detailed Description section. Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

References throughout the foregoing description to features, advantages, or similar language do not imply that all of the features and advantages that may be realized with the present technology should be or are in any single embodiment of the invention. Rather, language referring to the features and advantages is understood to mean that a specific feature, advantage, or characteristic described in connection with an embodiment is included in at least one embodiment of the present technology. Thus, discussion of the features and advantages, and similar language, throughout this specification may, but do not necessarily, refer to the same embodiment. Furthermore, the described features, advantages, and characteristics of the present technology may be combined in any suitable manner in one or more embodiments. One skilled in the relevant art will recognize that the present technology can be practiced without one or more of the specific features or advantages of a particular embodiment. In other instances, additional features and advantages may be recognized in certain embodiments that may not be present in all embodiments of the present technology. Aspects of the technology can be modified, if necessary, to employ the systems, functions, and concepts of the various references described above to provide yet further implementations of the invention.

The teachings of the invention provided herein can be applied to other systems, not necessarily the system described above. The elements and acts of the various examples described above can be combined to provide further implementations of the invention. Some alternative implementations of the invention may include not only additional elements to those implementations noted above, but also may include fewer elements. Further, any specific numbers noted herein are only examples: alternative implementations may employ differing values or ranges.

While the above description describes various embodiments of the invention and the best mode contemplated, regardless of how detailed the above text is, the invention can be practiced in many ways. Details of the system may vary considerably in its specific implementation, while still being encompassed by the present disclosure. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

Although certain aspects of the invention are presented below in certain claim forms, the applicant contemplates the various aspects of the invention in any number of claim forms. Accordingly, the applicant reserves the right to pursue additional claims after filing this application to pursue such additional claim forms, in either this application or in a continuing application.

I claim:

1. A coin processing machine comprising:

a coin hopper configured to receive a plurality of coins of random denominations; and a plurality of coin carriers linked together in an endless chain, wherein the endless chain is configured to circulate through the coin hopper, wherein each of the coin carriers is configured to receive a coin from the coin hopper and carry the coin away from the coin hopper, wherein the plurality of coin carriers includes a first coin carrier pivotally linked to a second coin carrier about an axis extending through the first coin carrier and the second coin carrier, and wherein the first coin carrier includes a coin mover configured to operate along the axis to displace coins from the first coin carrier.

2. The coin processing machine of claim 1 wherein the axis is a first axis, wherein the first coin carriers has a first end portion pivotally linked to the second coin carriers about the first axis and a second end portion pivotally linked to a third coin carriers about a second axis.

3. The coin processing machine of claim 1 wherein each of the coin carriers includes a coin pocket configured to receive a coin from the coin hopper and carry the coin away from the hopper.

4. The coin processing machine of claim 1, further comprising a biasing member operably disposed between the first coin carriers and the coin mover, wherein the biasing member is configured to return the coin mover toward the first coin carrier after displacing coins from the first coin carrier.

5. The coin processing machine of claim 1 wherein each of the coin carriers includes:

a coin pocket configured to receive a coin from the coin hopper and carry the coin away from the coin hopper; and a coin mover configured to push coins from the coin pocket.

6. The coin processing machine of claim 1 wherein the endless chain is configured to circulate in a plane inclined at an angle relative to a horizontal plane.

7. The coin processing machine of claim 1 wherein the endless chain is configured to circulate in a plane inclined at an angle of from 15 degrees to 80 degrees relative to a horizontal plane.

8. The coin processing machine of claim 1, further comprising a wheel, wherein the endless chain operably extends around at least a portion of the wheel.

9. The coin processing machine of claim 1, further comprising:

a first wheel assembly; and a second wheel assembly, wherein the endless chain operably extends around a portion of the first wheel assembly and a portion of the second wheel assembly.

10. The coin processing machine of claim 1, further comprising:

a first sprocket; and a second sprocket, wherein the endless chain operably extends around a portion of the first sprocket and a portion of the second sprocket, and wherein one of the first and second sprockets is a drive sprocket configured to move the endless chain.

11. The coin processing machine of claim 1, further comprising:

a coin sensor, wherein the plurality of coin carriers are configured to carry the coins received from the coin hopper past the coin sensor, and wherein the coin sensor is configured to sense at least one coin characteristic as the coins move past the coin sensor.

12. A system for counting and/or sorting coins, the system comprising:

a first wheel;

a second wheel spaced apart from the first wheel;

a plurality of coin carriers, wherein each of the coin carriers is pivotally coupled to two other of the coin carriers in end-to-end relationships, the plurality of coin carriers forming a continuous chain that operably extends around the first and second wheels, and wherein each of the coin carriers includes a corresponding coin mover configured to displace coins from the coin carrier, the coin mover operating along a pivot axis extending through at least two adjacent coin carriers; and a coin hopper configured to receive a plurality of coins of random denominations, wherein rotation of at least one of the first and second wheels moves the coin carriers adjacent to the coin hopper, and wherein the coin carriers are configured to receive coins from the hopper and move the coins away from the coin hopper.

13. The system of claim 12 wherein the first and second wheels are coplanar, wherein the continuous chain extends in a path around the first and second wheels, and wherein the path has a lower segment that extends between the first and second wheels proximate a lower portion of the coin hopper.

14. The system of claim 12 wherein the first and second wheels are spaced apart from each other in a horizontal direction, wherein the continuous chain extends in an oval path around the first and second wheels, the oval path having a lower segment that extends adjacent to the coin hopper and an upper segment positioned above the lower segment, wherein the coin machine further comprises:

at least one coin chute, the coin chute having an inlet positioned to receive coins from the coin carriers as the coin carriers move along the upper segment of the oval path.

15. The system of claim 12 wherein the continuous chain circulates in a path around the first and second wheels, and wherein the system further comprises:

a coin sensor positioned adjacent to the path, wherein the coin sensor is configured to sense at least one property of the coins as they move past the coin sensor in the individual coin carriers; and an actuator positioned adjacent to the path, wherein the actuator is configured to cause the coin movers to displace the coins from the individual carriers based at least in part on the property sensed by the coin sensor.

16. The system of claim 12, further comprising means for selectively displacing coins from the coin carriers.

17. The system of claim 12, further comprising:

a coin bin;

means for discriminating acceptable coins from unacceptable coins while the coins are being carried by the coin carriers; and means for moving the acceptable coins from the coin carriers and into the coin bin.

18. The system of claim 12, further comprising:

a first coin bin;

a second coin bin;

means for discriminating coins of a first denomination from coins of a second denomination while the coins are being carried by the coin carriers;

means for moving coins of the first denomination from the coin carriers to the first coin bin; and means for moving coins of the second denomination from the coin carriers to the second coin bin.

19. A coin conveyor comprising:

a plurality of links pivotally coupled together to form a continuous chain, wherein each of the links includes a coin pocket configured to support a coin lying flatwise in the pocket: and a plurality of plungers. wherein each of the plungers is operably coupled to at least one of the links and centered with respect to the coin pocket thereof, and wherein each of the plungers is movable between a first position in which the associated coin pocket can carry an individual coin and a second position in which the individual coin is displaced from the associated coin pocket.

20. The coin conveyor of claim 19 wherein each of the links is substantially identical to the other links.

21. The coin conveyor of claim 19 wherein each of the links is pivotally coupled to another one of the links about an axis, and wherein each of the plungers is aligned with a corresponding one of the axes.

22. The coin conveyor of claim 19 wherein the coin pocket includes a coin stabilizing feature configured to prevent a coin lying flatwise therein from rocking on an edge portion of the coin.

23. The coin conveyor of claim 19 wherein the coin pocket has a round shape.

24. The coin conveyor of claim 19 wherein the coin pocket has an outer wall, the outer wall having a round shape and a ridge configured to prevent a coin supported edgewise by the wall from rocking.

25. The coin conveyor of claim 19 wherein each of the plungers includes a circular head portion and each of the associated coin pockets includes a seat, wherein each of the head portions is positioned against the seat of the associated coin pocket when the corresponding plungers is in the first position, and wherein each of the head portions moves away from the seat to displace the individual coin from the associated coin pocket when the corresponding plunger is in the second position.

26. The coin conveyor of claim 19, further comprising:

a plurality of biasing members, wherein each of the biasing members is operably coupled to a corresponding one of the plungers, and wherein the biasing members bias the plungers toward the first position.

27. The coin processing machine of claim 2 wherein the coin mover is a first coin mover, and wherein the third coin carrier includes a second coin mover configured to operate along the second axis to displace coins from the third coin carrier.

28. The coin processing machine of claim 3 wherein the coin mover is concentrically aligned with the coin pocket of the first coin carrier.

29. The coin processing machine of claim 3 wherein the axis is located at the center of the coin pocket of the first coin carrier.

* * * * *

UNITED STATES PATENT AND TRADEMARK OFFICE

CERTIFICATE OF CORRECTION

PATENT NO. : 9,022,841 B2
APPLICATION NO. : 13/906126
DATED : May 5, 2015
INVENTOR(S) : Douglas A. Martin It is certified that error appears in the above-identified patent and that said Letters Patent is hereby corrected as shown below:

In the claims

In column 16, line 66, in claim 2, delete “carriers” and insert -- carrier --, therefor.

In column 16, line 67, in claim 2, delete “carriers” and insert -- carrier --, therefor.

In column 17, line 2, in claim 2, delete “carriers” and insert -- carrier --, therefor.

In column 17, line 9, in claim 4, delete “carriers” and insert -- carrier --, therefor.

In column 18, line 54, in claim 19, delete “pocket:” and insert -- pocket; --, therefor.

In column 18, line 55, in claim 19, delete “plungers.” and insert -- plungers, --, therefor.

Signed and Sealed this
Twentieth Day of October, 2015

Michelle K. Lee

Michelle K. Lee
*Director of the United States Patent and Trademark Office*